US008145101B2

(12) United States Patent
Terai et al.

(10) Patent No.: US 8,145,101 B2
(45) Date of Patent: Mar. 27, 2012

(54) DEVELOPING DEVICE, IMAGE FORMING APPARATUS AND PROCESS CARTRIDGE IN WHICH A SHOCK IS APPLIED INTERMITTENTLY TO THE DISCHARGED DEVELOPER

(75) Inventors: Junichi Terai, Kanagawa (JP); Koichi Kato, Kanagawa (JP); Koichi Sakata, Shizuoka (JP); Maiko Koeda, Shizuoka (JP); Kentaroh Tomita, Kanagawa (JP); Kiyonori Tsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 916 days.

(21) Appl. No.: 12/135,413

(22) Filed: Jun. 9, 2008

(65) Prior Publication Data

US 2008/0317508 A1 Dec. 25, 2008

(30) Foreign Application Priority Data

Jun. 19, 2007 (JP) ..... 2007-160953

(51) Int. Cl.
*G03G 15/08* (2006.01)

(52) U.S. Cl. ..... 399/257

(58) Field of Classification Search ..... 399/120, 399/254, 255, 256, 257, 258, 264, 359, 360
See application file for complete search history.

(56) References Cited

U.S. PATENT DOCUMENTS 6,266,511 B1 * 7/2001 Murakami et al. ..... 399/358
6,366,755 B1 * 4/2002 Takashima ..... 399/254
7,333,763 B2 * 2/2008 Choi ..... 399/358
7,627,280 B2 * 12/2009 Sato ..... 399/360
7,894,760 B2 * 2/2011 Gunbe ..... 399/358
2007/0160392 A1 7/2007 Tsuda et al.
2007/0264052 A1 11/2007 Yoshida et al.
2008/0038021 A1 2/2008 Tsuda et al.

FOREIGN PATENT DOCUMENTS

JP 05053430 A * 3/1993
JP 10161499 A * 6/1998
JP 2001147629 A * 5/2001
JP 2003-337469 11/2003
JP 2007108225 A * 4/2007

* cited by examiner

*Primary Examiner* — Robert Beatty
(74) *Attorney, Agent, or Firm* — Oblon, Spivak, McClelland, Maier & Neustadt, L.L.P.

(57) ABSTRACT

A developing device capable of conveying discharged developer to the outside of the device well by preventing developer from firmly adhering within a discharge conveyance path, as well as an image forming apparatus and a process cartridge having this developing device. A developing device, having: a developing roller; a developer conveyance path having a supply screw and a supply conveyance path; a toner replenishment controller for replenishing the developer to the developer conveyance path; a discharge conveyance path for conveying the developer to the outside of the developing device; a discharge screw serving as a discharge conveying member for applying a conveying force to the developer within the discharge conveyance path; and a developer discharge port serving as developer discharge means for discharging the developer to the discharge conveyance path, wherein the conveying force is applied to the discharged developer intermittently by the discharge screw serving as a discharge conveying member, whereby a shock is applied intermittently to the discharged developer within the discharge conveyance path.

12 Claims, 12 Drawing Sheets

DEVELOPING DEVICE, IMAGE FORMING APPARATUS AND PROCESS CARTRIDGE IN WHICH A SHOCK IS APPLIED INTERMITTENTLY TO THE DISCHARGED DEVELOPER

BACKGROUND OF THE INVENTION

1. Field of the Invention

The present invention relates to a developing device used in a copying machine, a facsimile device, a printer and the like, and an image forming apparatus and a process cartridge that use the developing device.

2. Description of the Related Art

There has conventionally been widely used an image forming apparatus with a developing device using a two-component developer composed of toner and magnetic carrier. As this type of image forming apparatus, there is an image forming apparatus in which toner is replenished, according to need, from a toner container to a developer contained in a developing device that consumes toner as it conducts development, and thereby maintains the toner density of the developer within a predetermined range. In such a configuration, because the carrier within the developer is repeatedly used without being consumed significantly, the carrier degrades as an image is output. Specifically, the coated layer on the surface of the carrier is scraped off due to mechanical stress, and spent toner component is formed on the carrier surface. When the carrier degrades, the ability of the carrier to charge the toner decreases gradually, causing not only abnormal images such as scumming, image density reduction and image density irregularity, but also toner scattering. Therefore, a serviceman is sent to the user of this type of image forming apparatus to replace the carrier regularly. For this reason, the maintenance cost and the cost per image formation increase.

Japanese Patent Application No. 2891845 and Japanese Unexamined Patent Application Publication No. 2000-112238, for example, disclose a developing device in which a pre-mixed developer with a mixture of carrier and toner is replenished into a developer contained in the developing device in order to recover the toner density, and at the same time the increment of the developer is discharged from the developing device. In this configuration, old carrier is discharged little by little from the developing device by discharging the developer, and at the same time new carrier within the pre-mixed developer is replenished to the developer contained in the developing device. The carrier within the developer is replaced with the new carrier little by little by performing the above-described discharge and replenishment so that the carrier replacement work can be omitted.

However, the developer discharged from the developing device contains a larger proportion of degraded developer than the developer contained in the developing device. The degraded developer has a low fluidity, and thus there is a possibility that the developer firmly adheres to a conveying member that applies conveying force to the developer within a discharge conveyance path conveying the discharged developer. Specifically, when the conveying member that applies the conveying force to the developer in the conveyance path conveying the developer is a conveying screw, the developer having a low fluidity adheres and aggregates on a wing portion or an axis of the conveying screw, since the developer having a low fluidity has a high cohesive property.

When the developer has a high fluidity, the developer scatters easily in spite of its cohesive property, and the developer adhering to the conveying screw hardly aggregates and firmly adheres. When the developer has a low fluidity, on the other hand, the developer does not scatter once it aggregates, and thus the developer adhering to the conveying screw easily aggregates and firmly adheres. Because the developer adhering to the conveying screw only follows the rotation of the conveying screw, the rotation of the conveying screw does not apply the conveying screw to the developer. Moreover, when the fluidity of the developer to be conveyed is poor, the developer adhering firmly to the conveying screw aggregates gradually, reducing the conveying capability of the conveying screw.

Note that the problem in which the developer having a low fluidity adheres firmly to the conveying screw is not exclusive to the case where the conveying member is a screw, and thus the developer can firmly adhere to any conveying member that constantly applies a fixed conveying force to the developer.

In addition, when the developer firmly adheres to the conveying screw of the discharge conveyance path and thereby reduces the conveying performance of the developer within the conveyance path, the conveying capability of the discharge conveyance path drops in relation to the amount of developer to be discharged, which might clog up the discharge conveyance path. Also, a torque for rotating the conveying screw is increased by the firmly adhered developer, damaging the conveying member.

These problems are not exclusive to the developing device that uses a two-component developer composed of toner and magnetic carrier, and thus might occur in any developing device that uses a one-component developer, as long as such developing device is configured to discharge a developer by using developer discharge means.

SUMMARY OF THE INVENTION

The present invention was contrived in view of the above problems, and an object of the present invention is to provide a developing device capable of conveying discharged developer to the outside of the device well by preventing the developer from firmly adhering within a discharge conveyance path, and to provide an image forming apparatus and a process cartridge that have this developing device.

In an aspect of the present invention, a developing device comprises a developer carrier, which rotates while carrying a developer on a surface thereof, supplies a toner to a latent image on a surface of a latent image carrier at a section where the developer carrier faces the latent image carrier, and develops the latent image; a developer conveyance path, which has a developer conveying member conveying the developer, and conveys the developer while supplying the developer to the developer carrier in a developer supply region in which the developer is supplied to the developer carrier; a developer replenishing device for replenishing the developer to the developer conveyance path; a discharge conveyance path for conveying the developer to the outside of the developing device; a discharge conveying member, which applies a conveying force to the developer within the discharge conveyance path; and a developer discharging device for discharging at least part of the developer within the developer conveyance path to the discharge conveyance path in the form of a discharged developer. A shock is applied intermittently to the discharged developer within the discharge conveyance path.

In another aspect of the present invention, an image forming apparatus comprises at least a latent image carrier; a charging device for charging a surface of the latent image carrier; a latent image forming device for forming an electrostatic latent image on the latent image carrier; and a developing device for developing the electrostatic latent image into a toner image. The developing device comprises a developer carrier, which rotates while carrying a developer on a surface thereof, supplies a toner to a latent image on the surface of the latent image carrier at a section where the developer carrier faces the latent image carrier, and develops the latent image; a developer conveyance path, which has a developer conveying member conveying the developer, and conveys the developer while supplying the developer to the developer carrier in a developer supply region in which the developer is supplied to the developer carrier; a developer replenishing device for replenishing the developer to the developer conveyance path; a discharge conveyance path for conveying the developer to the outside of the developing device; a discharge conveying member, which applies a conveying force to the developer within the discharge conveyance path; and a developer discharging device for discharging at least part of the developer within the developer conveyance path to the discharge conveyance path in the form of a discharged developer, the discharged developer within the discharge conveyance path being applied with a shock intermittently.

In another aspect of the present invention, a process cartridge is configured to have at least a latent image carrier for carrying a latent image and a developing device means for developing the latent image on the latent image carrier, in a common holder as one unit, and is further configured to be detachable from a main body of an image forming apparatus that has the latent image carrier and the developing device. The developing device comprises a developer carrier, which rotates while carrying a developer on a surface thereof, supplies a toner to a latent image on the surface of the latent image carrier at a section where the developer carrier faces the latent image carrier, and develops the latent image; a developer conveyance path, which has a developer conveying member conveying the developer, and conveys the developer while supplying the developer to the developer carrier in a developer supply region in which the developer is supplied to the developer carrier; a developer replenishing device for replenishing the developer to the developer conveyance path; a discharge conveyance path for conveying the developer to the outside of the developing device; a discharge conveying member, which applies a conveying force to the developer within the discharge conveyance path; and a developer discharging device for discharging at least part of the developer within the developer conveyance path to the discharge conveyance path in the form of a discharged developer, the discharged developer within the discharge conveyance path being applied with a shock intermittently.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENT(S)

As an image forming apparatus to which the present invention is applied, an embodiment of a tandem color laser copying machine (simply called "copying machine 500" hereinafter) in which a plurality of photoreceptors are disposed in parallel with each other will now be described hereinafter.

Figure 1:
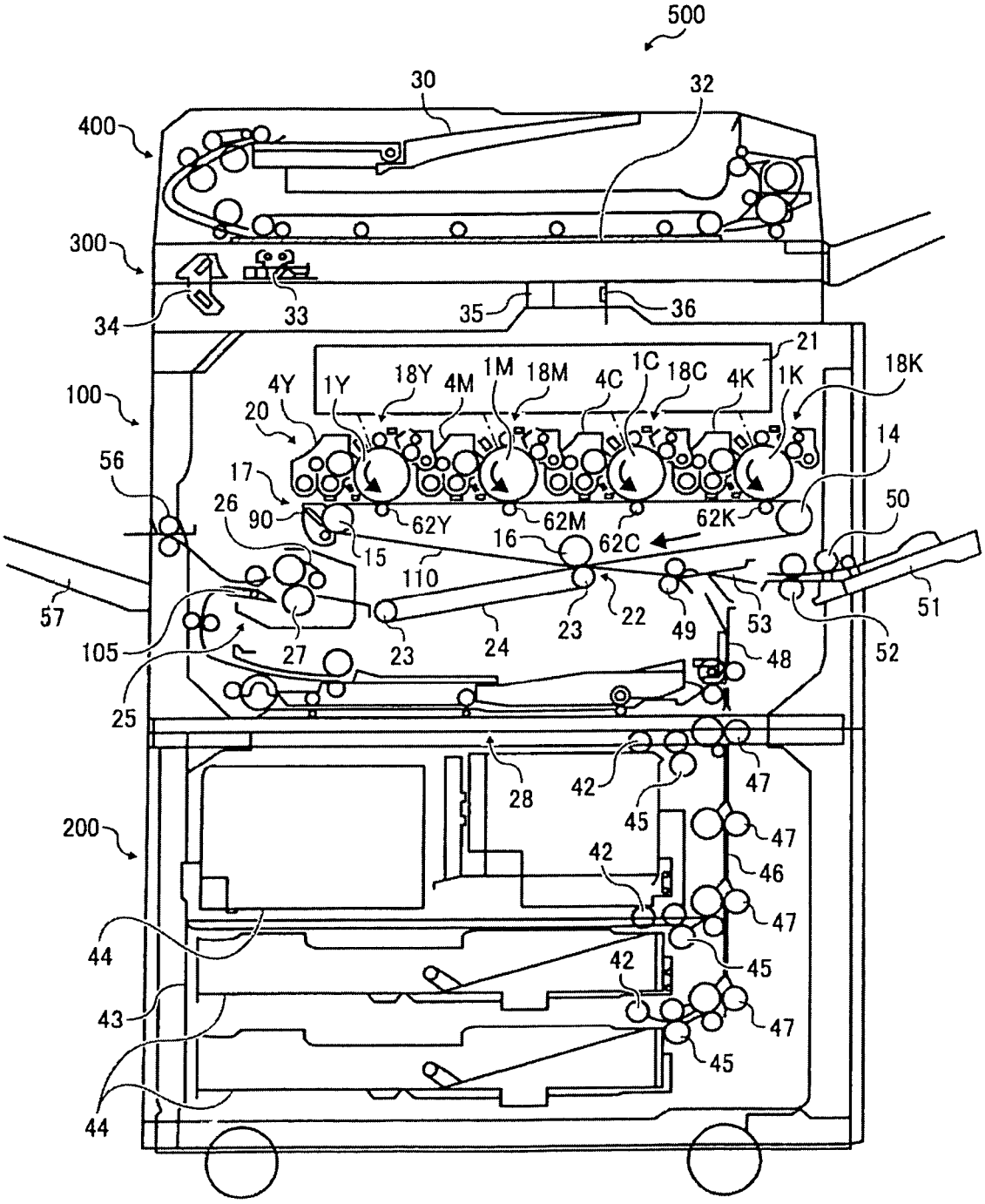
FIG. 1 is a diagram showing a schematic configuration of a copying machine according to an embodiment of the present invention.

FIG. 1 shows a schematic configuration of a copying machine 500 according to the present embodiment. The copying machine 500 has a printer portion 100, a sheet feeding device 200 on which the printer portion 100 is placed, a scanner 300 fixedly placed on the printer portion 100, and the like. The copying machine 500 also has an automatic original conveying device 400 that is placed fixedly on the scanner 300.

The printer portion 100 has an image forming unit 20 that is constituted by four process cartridges 18Y, M, C and K for forming images of colors of yellow (Y), magenta (M), cyan (C), and black (K) respectively. Y, M, C and K provided at the ends of the reference numerals indicate the members for the colors, yellow, cyan, magenta and black, respectively (same hereinafter). In addition to the process cartridges 18Y, M, C and K, an optical writing unit 21, an intermediate transfer unit 17, a secondary transfer device 22, a resist roller pair 49, a belt fixing type fixing device 25 and the like are disposed.

The optical writing unit 21 has a light source, a polygon mirror, an f-θ lens, a reflecting mirror and the like, which are not shown, and emits a laser beam onto the surface of an after-described photoreceptor on the basis of image data.

Each of the process cartridges 18Y, M, C and K has a drum-like photoreceptor 1, a charging unit, a developing device 4, a drum cleaning device, a destaticizing unit, and the like.

The yellow process cartridge 18 will now be described hereinafter.

The surface of a photoreceptor 1Y is uniformly charged by the charging unit functioning as charging means. The surface of the photoreceptor 1Y that is subjected to the charging processing is irradiated with a laser beam that is modulated and deflected by the optical writing unit 21. Consequently, the potential of the irradiated portion (exposed portion) on the surface of the photoreceptor 1Y is attenuated. Due to this attenuation of the potential of the surface, a Y electrostatic latent image is formed on the surface of the photoreceptor 1Y. The formed Y electrostatic latent image is developed into a Y toner image by a developing device 4Y serving as developing means.

The Y toner image formed on the Y photoreceptor 1Y is primarily transferred to an intermediate transfer belt 110 which is described hereinafter. Transfer residual toner on the surface of the photoreceptor 1Y is cleaned by the drum cleaning device after the Y toner image is primarily transferred.

In the Y process cartridge 18Y, the photoreceptor 1Y that is cleaned by the drum cleaning device is destaticized by the destaticizing unit. Then, the photoreceptor 1Y is uniformly charged by the charging unit and thereby returns to the initial state. The series of processes described above is the same for the other process cartridges 18M, C and K.

The intermediate transfer unit will now be described hereinafter.

The intermediate transfer unit 17 has the intermediate transfer belt 110, a belt cleaning device 90 and the like. The intermediate transfer unit 17 further has a stretching roller 14, a drive roller 15, a secondary transfer backup roller 16, four primary transfer bias rollers 62Y, M, C and K, and the like.

The intermediate transfer belt 110 is tension-stretched by a plurality of rollers including the stretching roller 14. The intermediate transfer belt 110 is then moved endlessly in a clockwise direction in the drawing by the rotation of the drive roller 15 that is driven by a belt drive motor which is not shown.

Each of the four primary transfer bias rollers 62Y, M, C and K is disposed in contact with the inner peripheral surface of the intermediate transfer belt 110, and is applied with a primary transfer bias from a power source, which is not shown. Furthermore, the inner peripheral surface of the intermediate transfer belt 110 is pressed against the photoreceptors 1Y, M, C and K to form primary transfer nips. At each of the primary transfer nips, a primary transfer electric field is formed between each photoreceptor 1 and each primary transfer bias roller 62 due to the influence of the primary transfer bias.

The abovementioned Y toner image formed on the Y photoreceptor 1Y is primarily transferred onto the intermediate transfer belt 110 due to the influence of the primary transfer electric field or nip pressure. M, C and K toner images formed on the respective M, C and K photoreceptors 1M, C and K are sequentially superimposed and primarily transferred onto the Y toner image. A four-color superimposed toner image (called "four-color toner image" hereinafter), i.e., a multiple toner image, is formed on the intermediate transfer belt 110 due to the primary transfer performed subsequently to the superimposition of the toner images.

The four-color toner image that is transferred onto the intermediate transfer belt 110 is secondarily transferred onto a transfer sheet, i.e., a recording medium that is not shown, by a secondary transfer nip described hereinafter. The residual transfer toner that remains on the surface of the intermediate transfer belt 110 after the four-color toner image passes through the secondary transfer nip is cleaned by the belt cleaning device 90 that holds the belt between this belt cleaning device and the drive roller 15 located on the left side of the drawing.

Next, the secondary transfer device 22 will be described.

The secondary transfer device 22 that stretches a sheet conveying belt 24 by means of two stretching rollers 23 is disposed on the lower side of the intermediate transfer unit 17 as shown. The sheet conveying belt 24 is endlessly moved in a counterclockwise direction in the drawing as at least either one of the stretching rollers 23 is driven and rotated. Of the two stretching rollers 23, the one roller disposed on the right side in the drawing holds the intermediate transfer belt 110 and the sheet conveying belt 24 between this stretching roller and the secondary backup roller 16 of the intermediate transfer unit 17. Accordingly, the secondary transfer nip where the intermediate transfer belt 110 of the intermediate transfer unit 17 comes into contact with the sheet conveying belt 24 of the secondary transfer device 22 is formed. Then, this stretching roller 23 is applied with a secondary transfer bias having a polarity opposite to the polarity of the toner, by the power source that is not shown. Due to this application of the secondary transfer bias, a secondary transfer electric field that electrostatically moves the four-color toner image formed on the intermediate transfer belt 110 of the intermediate transfer unit 17 from the belt side toward this stretching roller 23 is formed at the secondary transfer nip. The four-color toner image that is affected by the secondary transfer electric field or nip pressure is secondarily transferred onto the transfer sheet, which is sent to the secondary transfer nip by the after-described resist roller pair 49 in synchronization with the four-color toner image formed on the intermediate transfer belt 110. It should be noted that a charger for charging the transfer sheet in a noncontact manner may be provided in place of the secondary transfer system that applies a secondary transfer bias to this stretching roller 23.

In the sheet feeding device 200 provided in a lower section of the main body of the copying machine 500, a plurality of sheet feeding cassettes 44, each of which can contain a plurality of stacked transfer sheets, are disposed vertically in a stacked manner. Each of the sheet feeding cassettes 44 presses the top transfer sheet of the stacked transfer sheets against a sheet feeding roller 42. Then, by rotating the sheet feeding roller 42, the top transfer sheet is sent out toward a sheet feeding path 46.

The sheet feeding path 46 that receives the transfer sheet sent out from the sheet feeding cassette 44 has a plurality of conveying roller pairs 47 and the resist roller pair 49 that is provided in the vicinity of an end of the sheet feeding path 46. The sheet feeding path 46 conveys the transfer sheet toward the resist roller pair 49. The transfer sheet conveyed toward the resist roller pair 49 is sandwiched between the roller portions of the resist roller pair 49. On the other hand, in the intermediate transfer unit 17, the four-color toner image formed on the intermediate transfer belt 110 enters the secondary transfer nip as the belt endlessly moves. The resist roller pair 49 sends the transfer sheet, sandwiched between the roller portions, at timing at which the transfer sheet is attached to the four-color toner image at the secondary transfer nip. In this manner, the four-color toner image formed on the intermediate transfer belt 110 is attached to the transfer sheet at the secondary transfer nip. Then, the four-color toner image is secondarily transferred onto the transfer sheet and thereby becomes a full-color image on the white transfer sheet. The transfer sheet on which the full-color image is formed in this manner leaves the secondary transfer nip as the sheet conveying belt 24 endlessly moves, and is then sent from the top of the sheet conveying belt 24 to the fixing device 25.

The fixing device 25 has a belt unit that is caused to move endlessly while stretching a fixing belt 26 by means of two rollers, and a pressure roller 27 that is pressed against one of the rollers of the belt unit. The fixing belt 26 and the pressure roller 27 abut against each other to form a fixing nip, and the transfer sheet received from the sheet conveying belt 24 is sandwiched by this nip. Of the two rollers of the belt unit, the roller that is pressed by the pressure roller 27 has a heat source therein, which is not shown, and heats the fixing belt 26 by using heat generated by the heat source. The heated fixing belt 26 then heats the transfer sheet sandwiched by the fixing nip. Due to the application of heat or the nip pressure, the full-color image is fixed to the transfer sheet.

The transfer sheet that is subjected to the fixing processing in the fixing device 25 is either stacked on a stack portion 57 provided outside of a plate of a printer casing on the left side of the drawing, or is returned to the abovementioned secondary transfer nip in order to form a toner image on the other side of the transfer sheet.

When making a copy of an original, which is not shown, for example, a sheaf of sheet originals is set on an original platen 30 of the automatic original conveying device 400. However, if this original is a one-filing original closed by the subject document, the sheaf of sheet originals is set on a contact glass 32. Prior to this setting operation, the automatic original conveying device 400 is opened with respect to the copying machine main body, and thereby the contact glass 32 of the scanner 300 is exposed. Thereafter, the one-filing original is pressed and held by the closed automatic original conveying device 400.

After the original is set in this manner, a copy start switch, not shown, is pressed, whereby original reading operation is performed by the scanner 300. However, if a sheet original is set on the automatic original conveying device 400, the automatic original conveying device 400 automatically moves the sheet original to the contact glass 32 prior to the original reading operation. In the original reading operation, a first traveling body 33 and a second traveling body 34 start traveling together first, and light is emitted from a light source provided in the first traveling body 33. Then, the light reflected from the surface of the original is reflected by a mirror provided within the second traveling body 34, passes through an image forming lens 35, and thereafter enters a read sensor 36. The read sensor 36 constructs image information based on the reflected light.

In parallel with such original reading operation, each element within each of the process cartridges 18Y, M, C and K, the intermediate transfer unit 17, the secondary transfer device 22, and the fixing device 25 start driving. Then, the optical writing unit 21 is driven and controlled based on the image information constructed by the read sensor 36, and Y, M, C and K toner images are formed on the photoreceptors 1Y, M, C and K respectively. These toner images become a four-color toner image by superimposing and transferring these toner images on the intermediate transfer belt 110.

Moreover, at substantially the same time as when the original reading operation is performed, a sheet feeding operation is started in the sheet feeding device 200. In this sheet feeding operation, one of the sheet feeding rollers 42 is selected and rotated, and transfer sheets are sent out from one of the sheet feeding cassettes 44 that are stored in multiple stages in a sheet bank 43. The sent transfer sheets are separated one by one by a separation roller 45. Each sheet enters a reversal sheet feeding path 46 and is then conveyed to the secondary transfer nip by the conveying roller pairs 47. A manual tray 51 sometimes feeds the sheets in substitution for the sheet feeding cassettes 44. In this case, after a manual sheet feeding roller 50 is selected and rotated to send out transfer sheets placed on the manual tray 51, a separation roller 52 separates the transfer sheets one by one and feeds each sheet to a manual sheet feeding path 53 of the printer portion 100.

In the present copying machine 500, when forming a color image composed of toners of two or more colors, the intermediate transfer belt 110 is stretched such that an upper stretching surface thereof lies substantially horizontally, and all of the photoreceptors 1Y, M, C and K are brought into contact with the upper stretching surface. On the other hand, when forming a monochrome image composed of the K toner only, the intermediate transfer belt 110 is tilted downward to the left in the drawing by using a mechanism, not shown, and the upper stretching surface is separated from the Y, M and C photoreceptors 1Y, M and C. Then, out of the four photoreceptors 1Y, M, C and K, only the K photoreceptor 1K is rotated in the counterclockwise direction in the drawing to form a K toner image only. At this moment, for Y, M and C, driving of the respective photoreceptors 1 and of the developing device 4 is stopped to prevent each of the members of the photoreceptors 1 or developing device 4 and the developer within the developing device 4 from being depleted unnecessarily.

The copying machine 500 has a control unit, not shown, which is configured by a CPU and the like that control the elements within the copying machine 500, and an operation display portion, not shown, which is configured by a liquid crystal display, various keybuttons, and the like. An operator can select one of three one-side printing modes for forming an image on one side of a transfer sheet, by sending a command to the control unit based on the implementation of a key input operation in the operation display portion. The three one-side printing modes are a direct discharge mode, a reversal discharge mode, and a reversal decal discharge mode.

Figure 2:
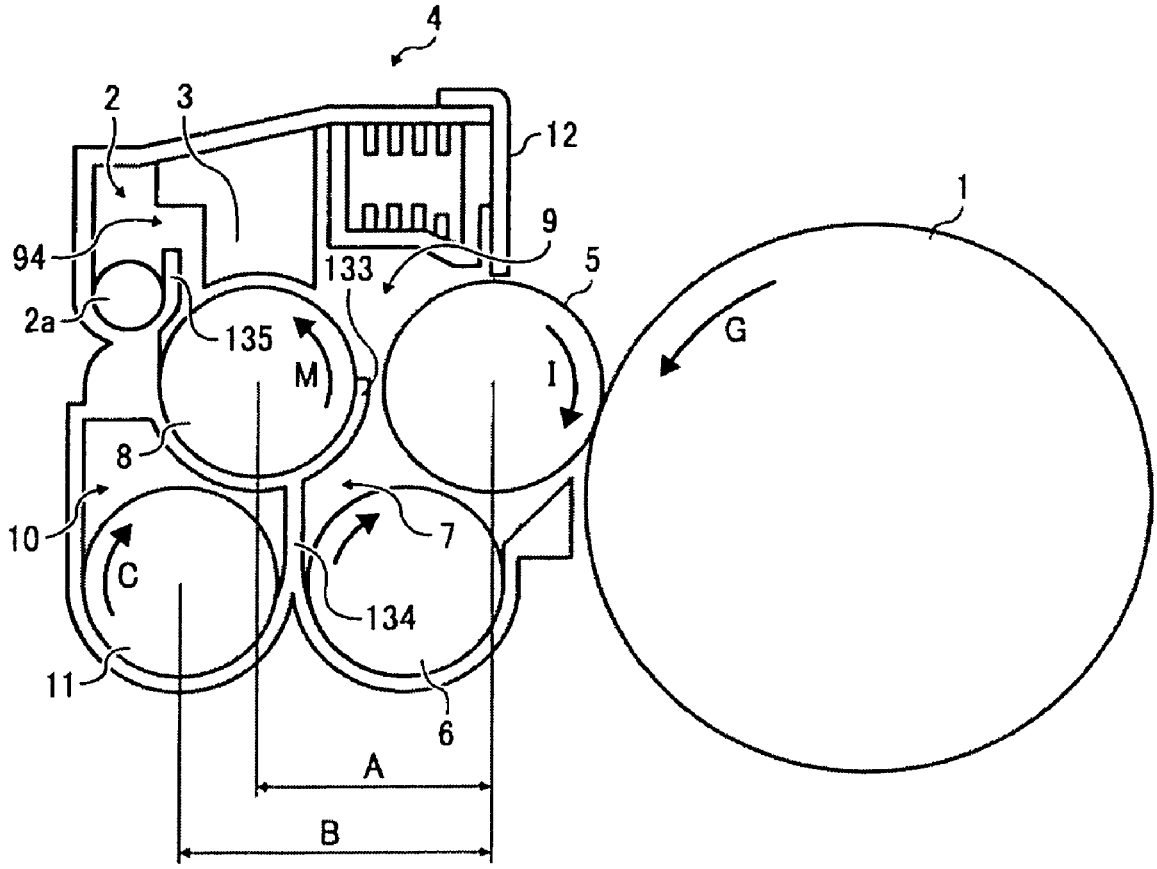
FIG. 2 is a diagram showing schematic configurations of a developing device and a photoreceptor of the copying machine.

FIG. 2 shows the configurations of the developing device 4 provided in one of the four process cartridges 18Y, M, C and K and of the photoreceptor 1. Apart from the fact that they handle different colors, the configurations of the four process cartridges 18Y, M, C and K are essentially identical and, accordingly, the letters Y, M, C and K applied to the "4" of the drawing have been omitted.

The surface of the photoreceptor 1 is charged by the charging device, which is not shown, as it rotates in the direction of the arrow G in the drawing shown in FIG. 2. Toner is supplied from the developing device 4 to a latent image, which is formed as an electrostatic latent image on the surface of the charged photoreceptor 1 by a laser beam irradiated from an exposure device, which is not shown, whereby a toner image is formed.

The developing device 4 has a developing roller 5 that serves as a developer carrier for supplying the toner to develop the latent image on the surface of the photoreceptor 1 while surface-moving in the direction of the arrow I of the drawing. The developing roller 5 has a rotatable developing sleeve in which a magnetic body, not shown, which is composed of a plurality of magnetic poles, is disposed. The magnetic body is required for retaining the developer on the surface of the developing roller 5.

The developing device 4 also has a supply screw 8 serving as a supply conveying member for, while supplying the developer to the developing roller 5, conveying the developer in the direction toward the far side of FIG. 2 along the axis line direction of the developing roller 5.

A doctor blade 12 serving as developer regulating means for regulating the thickness of the developer supplied to the developing roller 5 to a thickness suitable for development is provided on the downstream side in the direction of surface movement of the developing roller 5 from a part where the developing roller 5 faces the supply screw 8.

A recovery conveyance path 7, which recovers the developer that passes through a developing region and is used for development after being released from the surface of the developing roller 5, faces the developing roller 5 on the downstream side in the direction of surface movement from the developing region being a part where the developing roller 5 faces the photoreceptor 1. The recovery conveyance path 7 has a spiral recovery screw 6, which is disposed in parallel with the axis line direction of the developing roller 5 and serves as a recovery conveying member for conveying the recovered recovery developer in the same direction as the direction of the supply screw 8 along the axis line direction of the developing roller 5. A supply conveyance path 9 having the supply screw 8 is disposed in the lateral direction of the developing roller 5, and the recovery conveyance path 7 having the recovery screw 6 is disposed below the developing roller 5 in parallel with the supply conveyance path 9.

Note that the developer can be separated/released from the developing roller 5 by setting a section for releasing the developer within the abovementioned magnetic body of the developing sleeve into a nonmagnetic state. Moreover, the magnetic poles of the magnetic body may be arranged so as to form a repulsive magnetic field in the section for releasing the developer.

A stirring conveyance path 10 is provided below the supply conveyance path 9 in the developing device 4 in parallel with the recovery conveyance path 7. The stirring conveyance path 10 has a spiral stirring screw 11, which is disposed in parallel with the axis line direction of the developing roller 5 and serves as a stirring/conveying member for, while stirring the developer along the axis line direction of the developing roller 5, conveying it in the opposite direction to the direction of the supply screw 8, the opposite direction being oriented on the near side in the drawing.

The supply conveyance path 9 and the stirring conveyance path 10 are partitioned by a first partition wall 133 serving as a partition member. In a part of the first partition wall 133 that partitions the supply conveyance path 9 and the stirring conveyance path 10 an opening portion is formed at both ends in the near side and far side of the drawing to thereby allow the supply conveyance path 9 and the stirring conveyance path 10 to communicate with each other.

Note that although the supply conveyance path 9 and the recovery conveyance path 7 are also partitioned by the first partition wall 133, there is no opening portion provided in the part of the first partition wall 133 that partitions the supply conveyance path 9 and the recovery conveyance path 7.

The two developer conveyance paths of the stirring conveyance path 10 and the recovery conveyance path 7 are also partitioned by a second partition wall 134 serving as a partition member. An opening portion is formed in the second partition wall 134 at the near side in the drawing to allow the stirring conveyance path 10 and the recovery conveyance path 7 to communicate with each other.

The supply screw 8, the recovery screw 6 and the stirring screw 11 serving as a developer conveying members are made of resin or metal. The diameter of each screw is set to $\phi 22$ [mm]. The supply screw is in the form of a double-thread screw and has a screw pitch of 50 [mm], and the recovery screw 6 and the stirring screw 11 each is in the form of a single-thread screw and has a screw pitch of 25 [mm]. The rotation speed of each screw is set to approximately 600 [rpm].

The developer that is thinned by the stainless doctor blade 12 on the developing roller 5 is conveyed to the developing region where the developing roller 5 faces the photoreceptor 1, and then development is performed. The surface of the developing roller 5 made of an Al or SUS pipe stock with a diameter of $\phi 25$ [mm] has a V-shaped groove or is sandblasted. The size of the gap formed between the doctor blade 12 and the photoreceptor 1 is approximately 0.3 [mm].

The developer obtained after the development is recovered by the recovery conveyance path 7, then conveyed to the near side of the cross section of FIG. 2, and then transferred to the stirring conveyance path 10 at the opening portion of the first partition wall 133 provided in a non-image region. It should be noted that toner is supplied from an after-mentioned toner replenishing port 95 to the stirring conveyance path 10, the toner replenishing port 95 being provided above the stirring conveyance path 10 and in the vicinity of the opening portion of the first partition wall 133 on the upstream side in a developer conveyance direction in the stirring conveyance path 10.

Next, the circulation of the developer within the three developer conveyance paths will be described.

Figure 3:
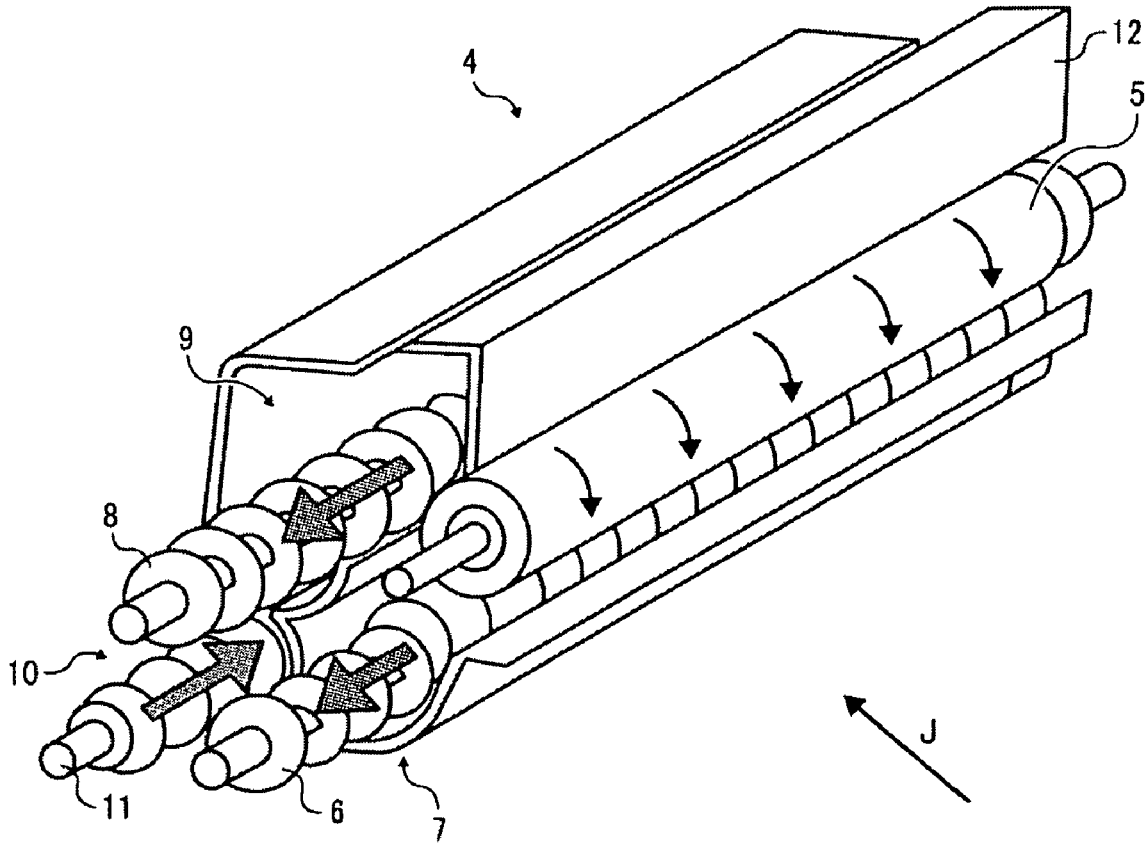
FIG. 3 is a perspective sectional view showing the developing device to explain a flow of a developer.

FIG. 3 shows a perspective sectional view of the developing device 4 to explain a flow of the developer within the developer conveyance paths. The arrows in the drawing indicate the directions of movement of the developer.

Figure 4:
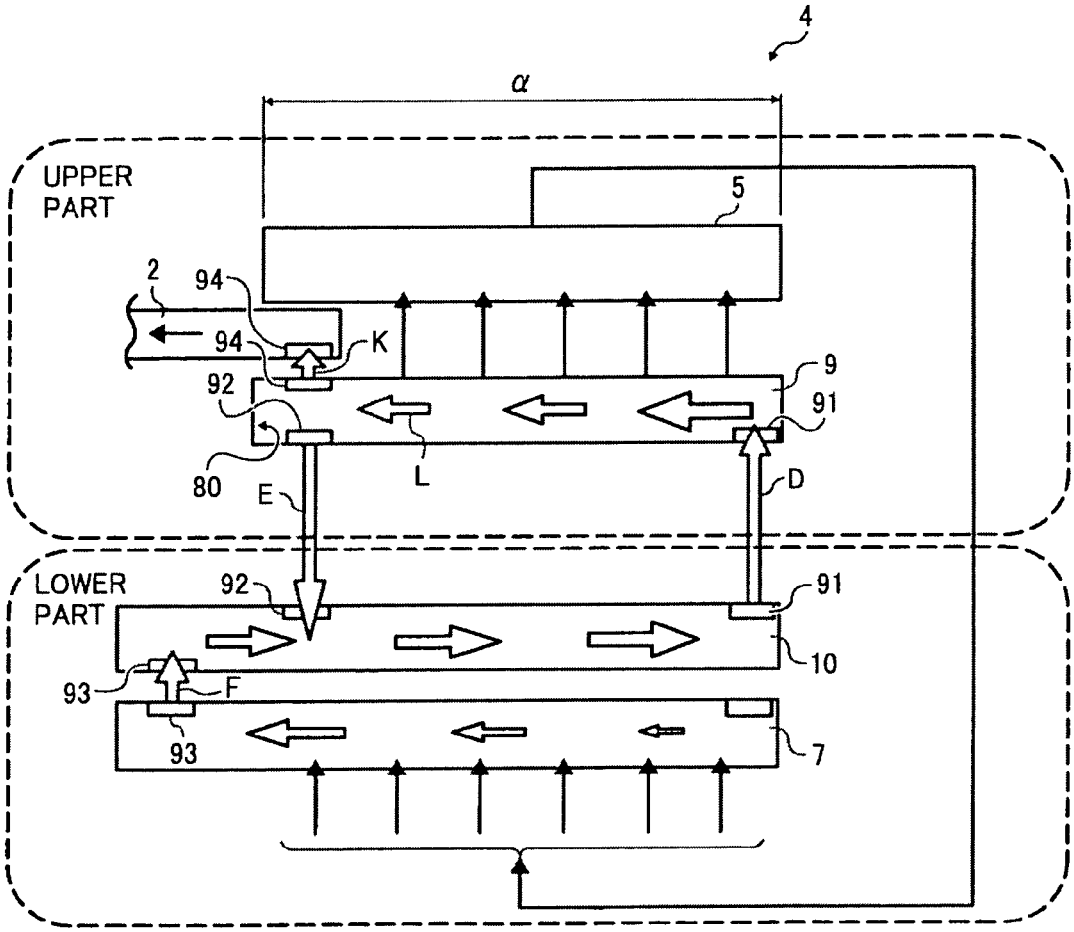
FIG. 4 is a schematic diagram showing the flow of the developer within the developing device.

Also, FIG. 4 is a schematic diagram showing a flow of the developer within the developing device 4. As with FIG. 3, the arrows in the diagram indicate the directions of movement of the developer.

In the supply conveyance path 9 to which the developer is supplied from the stirring conveyance path 10, the developer is conveyed to the downstream side in a conveyance direction of the supply screw 8, while being supplied to the developing roller 5. Excess developer that is supplied to the developing roller 5 and conveyed to a downstream end in a conveyance direction of the supply conveyance path 9 without being used for the development is supplied to the stirring conveyance path 10 through an excess opening portion 92 of the first partition wall 133 (arrow E in FIG. 4).

On the other hand, the developer supplied to the developing roller 5 is used for the development in the developing region, separated/released from the developing roller 5, and delivered to the recovery conveyance path 7. The recovery developer that is delivered from the developing roller 5 to the recovery conveyance path 7 and conveyed to a downstream end in a conveyance direction of the recovery conveyance path 7 by the recovery screw 6 is supplied to the stirring conveyance path 10 through a recovery opening portion 93 of the second partition wall 134 (arrow F in FIG. 4).

The stirring conveyance path 10 then stirs the supplied excess developer and recovery developer, conveys thus obtained mixture to the upstream side in the conveyance direction of the supply screw 8, which is also the downstream side in a conveyance direction of the stirring screw 11, and supplies it to the supply conveyance path 9 through a supply opening portion 91 of the first partition wall 133 (arrow D in FIG. 4).

In the stirring conveyance path 10, the recovery developer, excess developer, and toner replenished from a transporting portion according to need are stirred and conveyed by the stirring screw 11 in the direction opposite to that of the developer of the recovery path 7 and the supply path 9. The stirred developer is transported to the upstream side in the conveyance direction of the supply conveyance path 9 that is communicated at the downstream side in the conveyance direction through the supply opening portion 91. Note that a toner density sensor, not shown, which is configured by a permeability sensor, is provided below the stirring conveyance path 10, and a toner replenishment controller, not shown, is actuated by the output of the sensor to replenish the toner from a toner container which is not shown.

In the developing device 4 shown in FIG. 4 having the supply conveyance path 9 and the recovery conveyance path 7, because the developer is supplied and recovered in different developer conveyance paths, the developer used for the development is prevented from being mixed in the supply conveyance path 9. Accordingly, the toner density of the developer supplied to the developing roller 5 is prevented from decreasing as the developer is sent toward the downstream side in the conveyance direction of the supply conveyance path 9. In addition, because the developing device has the recovery conveyance path 7 and the stirring conveyance path 10 and the developer is recovered and stirred in these different developer conveyance paths, loss of the developer used for the development is prevented while it is being stirred. Therefore, since the sufficiently stirred developer is supplied to the supply conveyance path 9, supply of insufficiently stirred developer to the supply conveyance path 9 can be prevented. Because the toner density of the developer within the supply conveyance path 9 is prevented from decreasing and insufficient stirring of the developer in the supply conveyance path 9 is prevented in this manner, a constant image density can be ensured throughout development.

As shown in FIG. 4, the developer is moved from the lower part of the developing device 4 to the upper part of the same in the direction of the arrow D only. The developer is moved in the direction of the arrow D to raise the developer and supply it to the supply conveyance path 9 by pushing the developer existing on the downstream side of the stirring conveyance path 10 as the stirring screw 11 rotates.

Such movement of the developer causes stress on the developer, reducing the life of the developer.

When the developer is lifted up as described above, stress is placed on the developer, scraping a carrier film, and spent toner is formed on the stressed part of the developer, and consequently stable image quality can no longer be maintained.

Therefore, the life of the developer can be extended by alleviating the stress that is placed on the developer moving in the direction of the arrow D. By extending the life of the developer, it becomes possible to provide a developing device capable of preventing the degradation of the developer and providing stable image quality with no image density irregularity.

In the developing device 4 of the present embodiment, the supply conveyance path 9 is disposed obliquely above the stirring conveyance path 10, as shown in FIG. 2. By disposing the supply conveyance path 9 in this manner, the stress placed on the developer moving in the direction of the arrow D can be alleviated more as compared with the case in which the supply conveyance path 9 is provided vertically above the stirring conveyance path 10 to lift up the developer.

Furthermore, since the supply conveyance path 9 and the stirring conveyance path 10 are disposed obliquely in the developing device 4, an upper wall surface of the stirring conveyance path 10 is disposed higher than a lower wall surface of the supply conveyance path 9 as shown in FIG. 2.

By lifting up the supply conveyance path 9 vertically above the stirring conveyance path 10, the developer is lifted up by the pressure of the stirring screw 11 against gravitational force, imposing stress on the developer. However, by disposing the upper wall surface of the stirring conveyance path 10 to be higher than the lower wall surface of the supply conveyance path 9, the developer existing at the uppermost point of the stirring conveyance path 10 can flow into the lowermost point of the supply conveyance path 9 without fighting gravity, and as a result the stress placed on the developer can be reduced.

It should be noted that a fin member may be provided on the axis of the stirring screw 11, which is a section through which the stirring conveyance path 10 and the supply conveyance path 9 are communicated with each other at the downstream side of the developer conveyance path of the stirring conveyance path 10. This fin member is a plate-like member configured by a side parallel to the axial direction of the stirring screw 11 and a side perpendicular to the axial direction of the stirring screw 11. By scooping up the developer using this fin member, the developer can be delivered from the stirring conveyance path 10 to the supply conveyance path 9 efficiently.

Moreover, in the developing device 4 the supply conveyance path 9 and the stirring conveyance path 10 are disposed such that the center distance A between the developing roller 5 and the supply conveyance path 9 is shorter than the center distance B between the developing roller 5 and the stirring conveyance path 10. In this manner, the developer can be supplied from the supply conveyance path 9 to the developing roller 5 naturally, and the size of the device can be reduced.

Also, the stirring screw 11 rotates in the counterclockwise direction as viewed from the near side of FIG. 2 (direction of the arrow C in the drawing) so that the developer is lifted up along the shape of the stirring screw 11 and transported to the supply conveyance path 9. Accordingly, the developer can be lifted up efficiently and also the stress placed thereon can be reduced.

Figure 5:
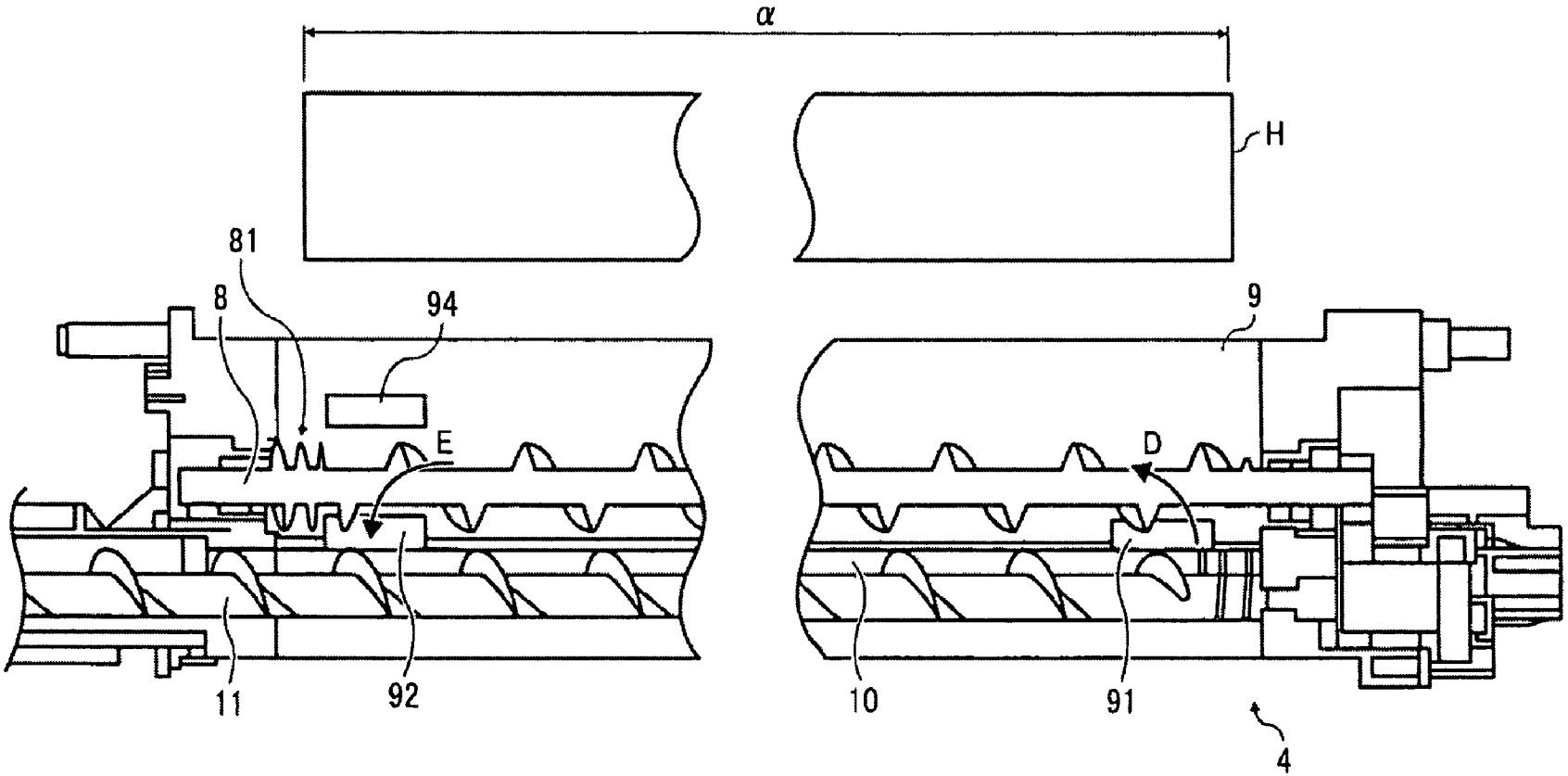
FIG. 5 is a diagram showing a cross section of the developing device.

FIG. 5 is a cross-sectional view of the rotation center of the supply screw 8 of the developing device 4, the rotation center being viewed in the direction of the arrow J shown in FIG. 3. Reference numeral H in the drawing shows the developing region in which the developing roller 5 serving as a developer carrier supplies the toner to the photoreceptor 1 serving as a latent image carrier. The width of the developing region H in the direction of the rotation axis of the developing roller 5 is the developing region width $\alpha$.

As shown in FIG. 5, the developing device 4 is provided with, within the developing region width $\alpha$, the supply opening portion 91 for lifting up the developer from the stirring conveyance path 10 to the supply conveyance path 9, and the excess opening portion 92 for dropping the developer from the supply conveyance path 9 to the stirring conveyance path 10.

Figure 6:
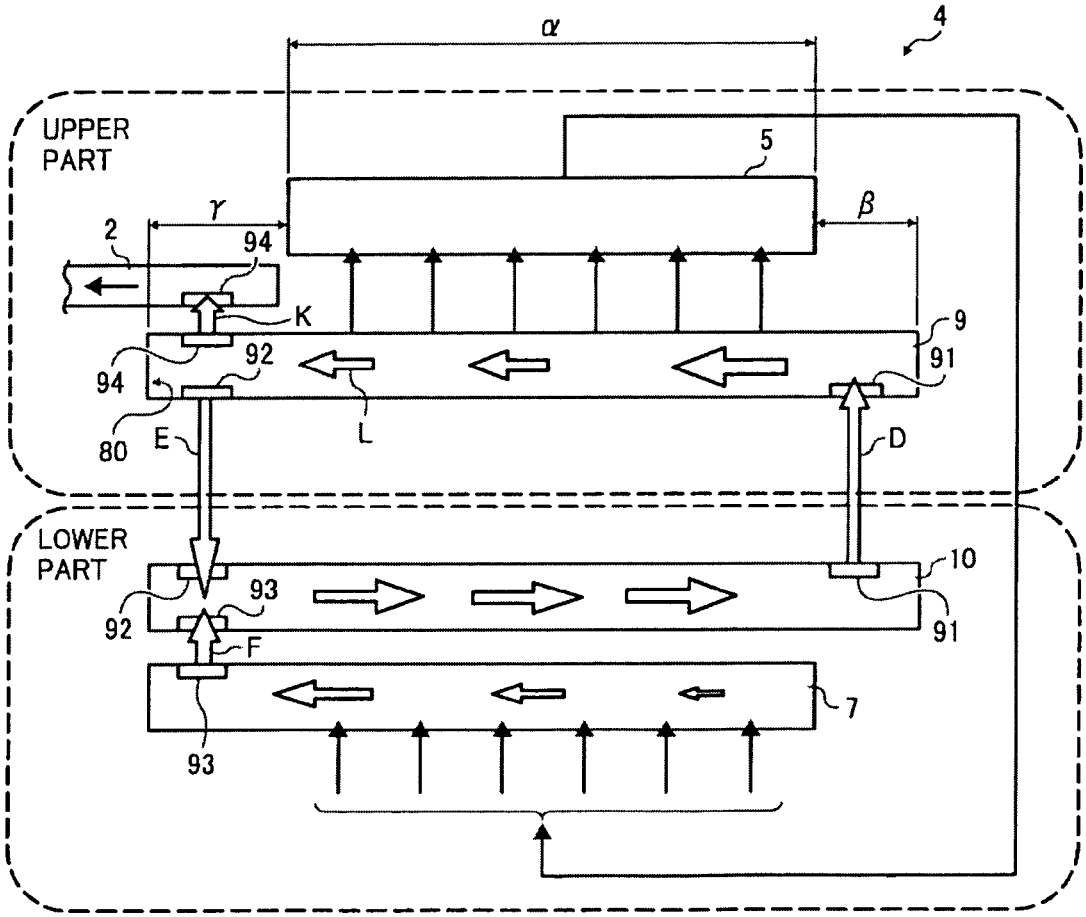
FIG. 6 is a schematic diagram showing a flow of a developer within the developing device, which is different from the flow of the developer shown in FIG. 4.

FIG. 6 shows a flow of the developer within the developing device 4 having a different configuration from the developing device shown in FIG. 4.

In the developing device 4 shown in FIG. 6, the supply opening portion 91 and the excess opening portion 92 are provided outside the developing region width $\alpha$. Since the supply opening portion 91 is provided outside the developing region width $\alpha$, the upstream side in the conveyance direction of the supply conveyance path 9 is longer than the developing roller 5 by a supply conveyance path upstream region $\beta$. Also, since the excess opening portion 92 is provided outside the developing region width $\alpha$, the downstream side in the conveyance direction of the supply conveyance path 9 is longer than the developing roller 5 by a supply conveyance path downstream region $\gamma$.

On the other hand, in the developing device 4 with the configuration shown in FIG. 4, because the supply opening portion 91 is provided within the developing region width $\alpha$, the upstream side in the conveyance direction of the supply conveyance path 9 can be made shorter than the developing device 4 of FIG. 6 by the supply conveyance path upstream region $\beta$. Moreover, because the excess opening portion 92 is provided within the developing region width $\alpha$, the downstream side in the conveyance direction of the supply conveyance path 9 can be made shorter than the developing device 4 of FIG. 6 by the supply conveyance path downstream region $\gamma$.

Since the supply opening portion 91 and the excess opening portion 92 of the developing device 4 shown in FIG. 4 are provided within the developing region width $\alpha$ as described above, the space of the upper part of the developing device 4 can be saved more, as compared with the developing device 4 shown in FIG. 6.

Figure 7:
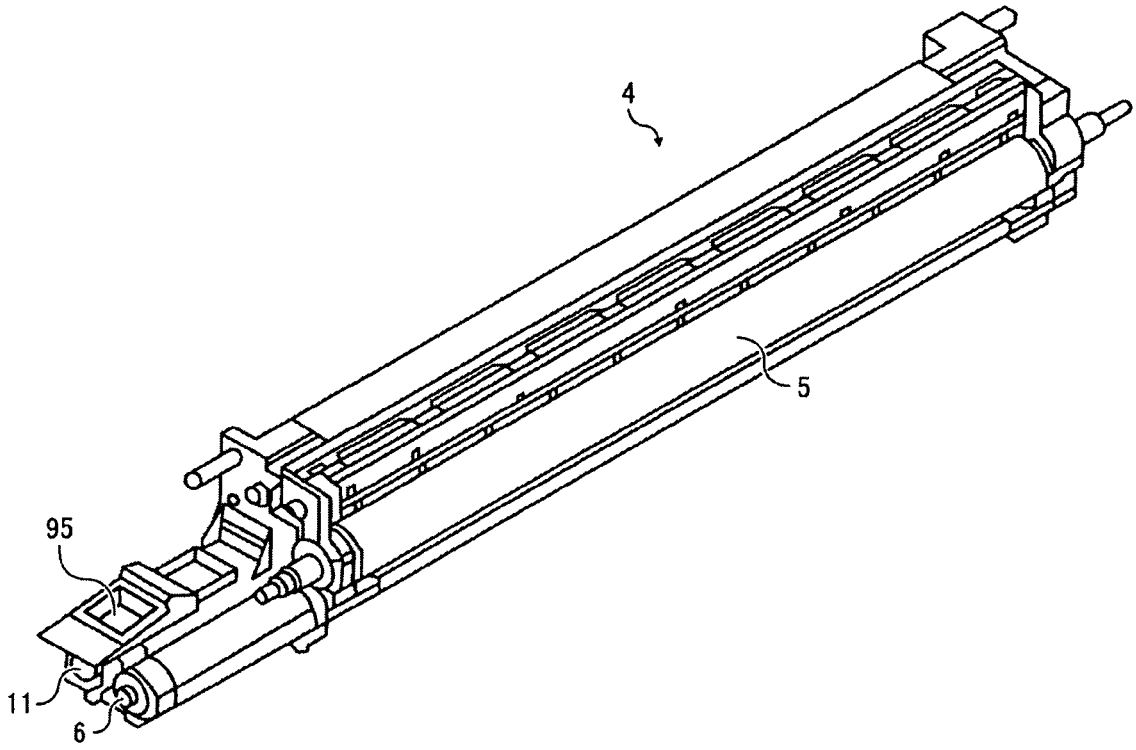
FIG. 7 is a perspective view showing the exterior of the developing device.

Next is described the position for replenishing the toner to the developer conveyance paths constituted by the supply conveyance path 9, the stirring conveyance path 10 and the recovery conveyance path 7 of the developing device 4. FIG. 7 is a perspective view showing the exterior of the developing device 4.

As shown in FIG. 7, the toner replenishing port 95 for replenishing the toner is provided above an upstream end portion in the conveyance direction of the stirring conveyance path 10 having the stirring screw 11. Because this toner replenishing port 95 is provided on the outer side than the end portion in the width direction of the developing roller 5, it is positioned outside the developing region width α.

The section provided with the toner replenishing port 95 is an extension of the conveyance direction of the supply conveyance path 9 and corresponds to an empty space of the supply conveyance path downstream region γ shown in FIG. 6. By providing the toner replenishing port 95 in the empty space obtained by providing the excess opening portion 92 within the developing region width α, the size of the developing device 4 can be reduced.

The toner replenishing port 95 may be provided not only above the upstream end portion in the conveyance direction of the stirring conveyance path 10, but also above a downstream end portion of the recovery conveyance path 7.

Moreover, the toner replenishing port 95 may be provided immediately above the recovery opening portion 93, which is a section where the developer is delivered from the recovery conveyance path 7 to the stirring conveyance path 10. Since the space immediately above the recovery opening portion 93 is also the empty space obtained by providing the excess opening portion 92 within the developing region width α, the size of the developing device 4 can be reduced by providing the toner replenishing port 95 at this position. Moreover, because the developer is easily mixed in the recovery opening portion 93 serving as a delivery portion, the developer can be stirred more efficiently by performing replenishment at this position.

As in the developing device 4 described with reference to FIG. 4, there are provided within the developing region width α the supply opening portion 91 for delivering the developer from the downstream end in the conveyance direction of the stirring conveyance path 10 to the upstream end in the conveyance direction of the supply conveyance path 9, and the excess opening portion 92 for delivering the developer from the downstream end of the supply conveyance path 9 to the upstream end in the conveyance direction of the stirring conveyance path 10. Therefore, as compared with the conventional developing device 4, the space in the upper part of the developing device 4 can be saved, and the spaces in the entire developing device 4 can be also saved.

Moreover, because the toner replenishing port 95 is provided in the empty space that is obtained by providing the excess opening portion 92 within the developing region width α, the size of the developing device 4 can be reduced.

Because the toner is replenished from the upper part of the recovery opening portion 93 serving as a delivery portion for delivering the developer from the recovery conveyance path 7 to the stirring conveyance path 10, the developer can be stirred efficiently.

In addition, since the developing device 4 is provided as developing means of the printer portion 100 of the copying machine serving as an image forming apparatus, the spaces of the entire apparatus can be saved.

The toner replenishment controller, not shown, which serves as developer replenishing means, replenishes the toner stored in the toner container, not shown, from the toner replenishing port 95 to the developing device 4. In the developing device 4 of the present embodiment, the developer having toner and carrier is replenished from the toner replenishing port 95 of the developing device 4. Hereinafter, the developer having a mixture of toner and carrier and replenished to the developing device 4 is referred to as "pre-mixed toner."

Figure 8:
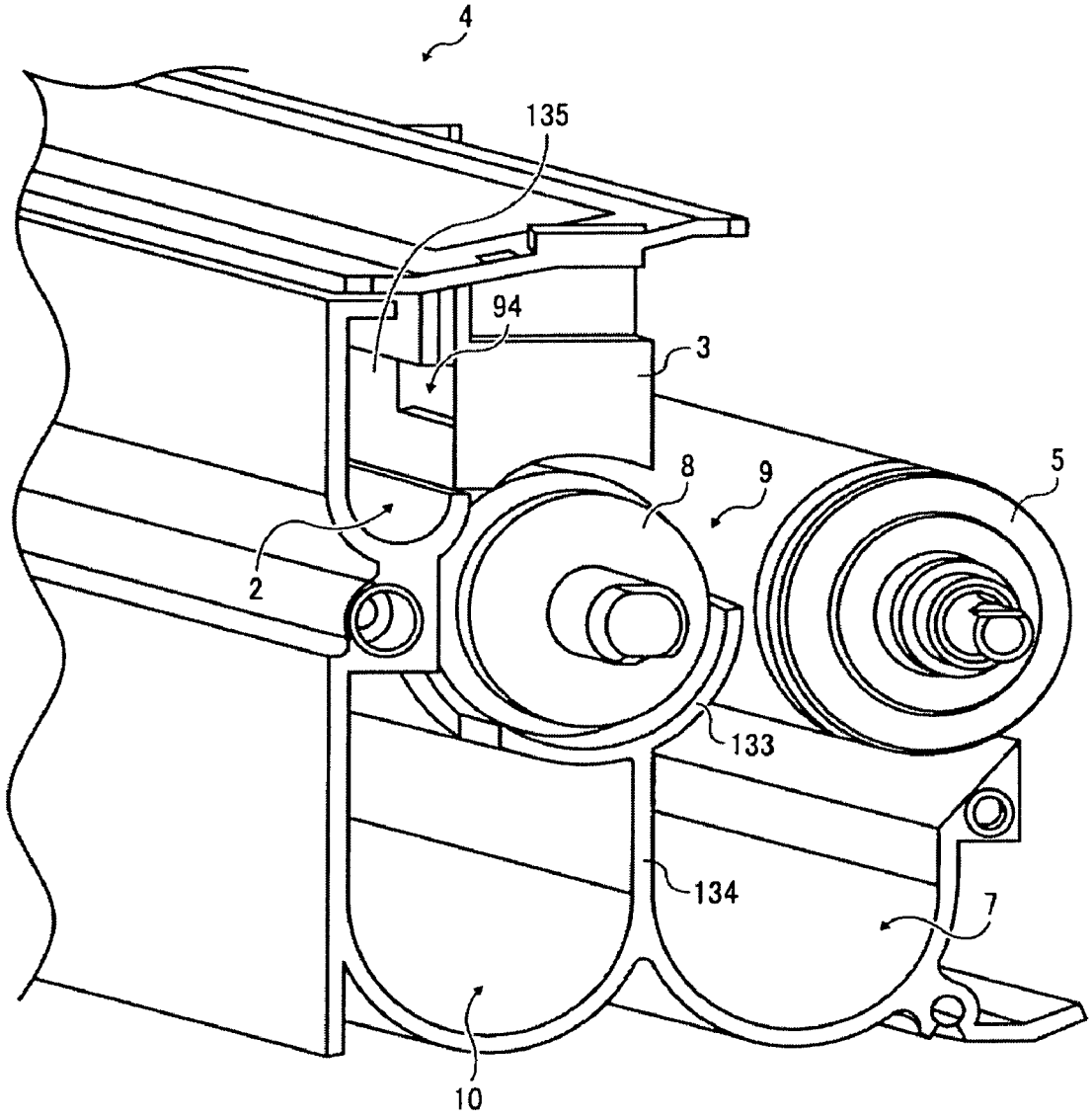
FIG. 8 is a perspective view showing the configuration of the vicinity of a near side end portion of the developing device, which is obtained after removing a stirring screw, a recovery screw, and a doctor blade from the developing device.

FIG. 8 shows the configuration of the vicinity of a near-side end portion of the developing device 4 in which a discharge screw 2*a* serving as a discharge conveying member, the stirring screw 11, recovery screw 6 and doctor blade 12 are removed therefrom.

In the developing device 4 of the present embodiment, the stirring conveyance path 10 serves as a circulation conveyance path for conveying the excess developer that reaches the downstream end in the conveyance direction of the supply conveyance path 9 to the upstream end in the conveyance direction of the supply conveyance path 9. Also, the stirring screw 11 serves as a circulating conveying member, which applies the conveying force to the developer within the stirring conveyance path 10 serving as a circulation conveyance path. The excess opening portion 92 serves as a circulation opening portion, which is provided in the vicinity of the downstream end in the conveyance direction of the supply conveyance path 9 and through which the passed developer is delivered to the stirring conveyance path 10 serving as a circulation conveyance path. Furthermore, in the developing device 4, the supply conveyance path 9 has a developer discharge port 94 that serves as developer discharge means for discharging the passed developer to the outside of the developing device 4. The developer that passes through the developer discharge port 94 is delivered to the discharge conveyance path 2 as a discharged developer, and conveyed in a direction (direction toward the far side of FIG. 2 and FIG. 8) opposite to the conveyance direction of the supply conveyance path 9 (direction toward the near side of FIG. 2 and FIG. 8) by the rotation of the discharge screw 2*a*.

The discharge conveyance path 2 is disposed on the downstream side in the conveyance direction of the supply conveyance path 9 such as to be adjacent to the supply conveyance path 9 with a partition wall 135 therebetween. The developer discharge port 94 is an opening provided on the partition wall 135 such that the supply conveyance path 9 and the discharge conveyance path 2 are communicated with each other.

The developing device 4 further has a supply downstream end wall surface 80 serving as developer accumulating means for accumulating, in the vicinity of the excess opening portion 92 serving as a circulation opening portion, the developer that reaches the vicinity of the downstream end in the conveyance direction of the supply conveyance path 9 but does not enter the excess opening portion 92. Moreover, the developer discharge port 94 serving as a discharge opening port is provided so as to allow the passage of the developer that reaches the position of the developer discharge port 94, the developer being part of the developer accumulated above the excess opening portion 92 and by the supply downstream end wall surface 80. In other words, the developer that reaches the vicinity of the downstream end in the conveyance direction of the supply conveyance path 9 but cannot enter the excess opening portion 92 and thereby spills out of the excess opening portion 92 is blocked by the supply downstream end wall surface 80 in the form of the excess developer, and becomes the accumulated developer. Then, when the bulk of this accumulated developer increases, the developer that reaches the developer discharge port 94 provided above the excess opening portion 92 is allowed to pass through the developer discharge port 94 and discharged to the discharge conveyance path 2.

Figure 9:
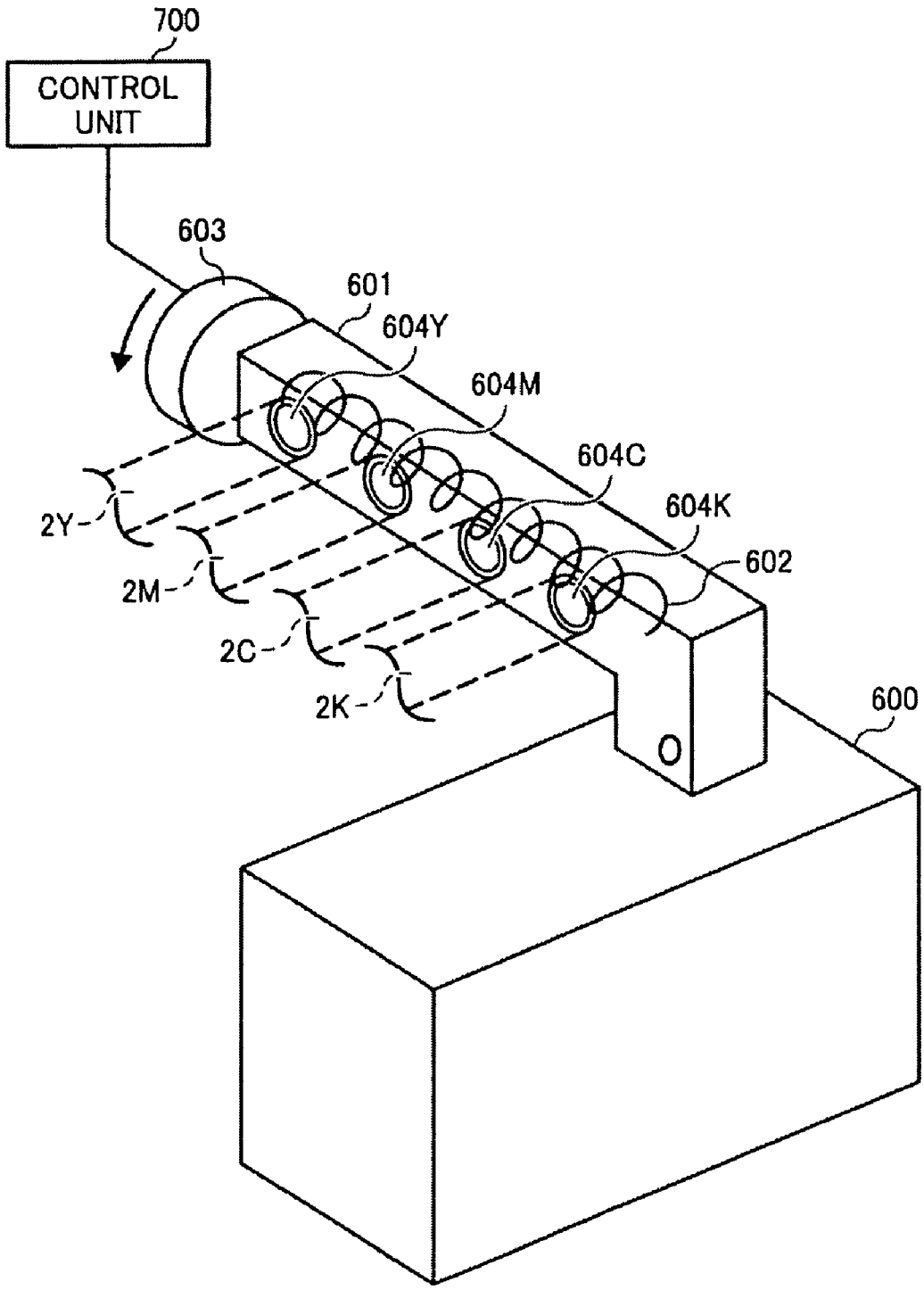
FIG. 9 is a diagram for explaining a discharged-developer transfer pipe.

FIG. 9 shows a discharged-developer transfer pipe 601 serving as a discharge conveyance path, which receives the discharged developer conveyed to the outside of a developing casing of the developing device 4 through the discharge conveyance path 2 and conveys the discharged developer to a discharged-developer tank 600 serving as a discharged-developer container.

The discharged developer is conveyed from the supply conveyance path 9 within each of the developing devices 4 (Y, M, C and K) to the end portion of the developing device 4 opposite to the developer discharge port 94 via the developer discharge port 94 by each of the discharge conveyance paths 2 (Y, M, C and K), and then discharged to the outside of the developing casing of the developing device 4.

The developer that is conveyed to the downstream end in the conveyance direction of the discharge conveyance path 2 (Y, M, C and K) and discharged from the casing of the developing device 4 enters the discharged-developer transfer pipe 601 from each of developer receiving port 604 (Y, M, C and K). The discharged-developer transfer pipe 601 has a discharge containing screw 602, which serves as a discharge containing conveying member for applying the conveying force to the discharged developer within the discharged-developer transfer pipe 601. One end of the discharged-developer transfer pipe 601 has a discharge containing screw drive source 603 for transferring the developer within the discharged-developer transfer pipe 601 successively by means of the rotation of the discharge containing screw 602 and causing the discharged-developer tank 600 serving as a discharged-developer container outside the developing device 4 to contain the successively transferred developer.

Note that FIG. 9 shows the configuration for conveying the discharged developer conveyed by the discharge conveyance path 2 (Y, M, C or K) to one discharged-developer tank 600, but the discharged-developer tank 600 for each color may be provided individually in accordance with the each discharge conveyance path 2 (Y, M, C or K).

The toner that is contained in the discharged developer discharged from the developer discharge port 94 to the discharge conveyance path 2 is degraded, has poor fluidity, and thus is firmly fixed within the discharge conveyance path 2 easily. The discharged developer also has poor fluidity particularly under an environment with high temperature and high humidity, and thus is firmly fixed easily.

Also, in a state in which the discharge screw 2*a* constantly rotates at a fixed rotation speed, the force applied to the discharged developer within the discharge conveyance path 2 does not fluctuate. For this reason, in a state in which the discharge screw 2*a* rotates at a fixed rotation speed, the discharged developer aggregates in a section where the discharge screw 2*a* can stop, without moving, and thereby adheres firmly within the discharge conveyance path 2. As the discharged developer that exists in the section where the discharge screw 2*a* can stop in a state in which the discharge screw 2*a* rotates at a fixed rotation speed, there is discharged developer that adheres to the axis or wing of the discharge screw 2*a* and follows the rotation of the discharge screw 2*a*. Such discharged developer that adheres to the discharge screw 2*a* and follows the rotation of the discharge screw 2*a* is not apply with the conveying force in spite of the rotation of the discharge screw 2*a*, and thereby stops while adhering to the discharge screw 2*a*.

Next, characterizing portions of the present embodiment will now be described.

In the developing device 4 of the present embodiment, the supply screw 8 serving as a developer conveying member, the recovery screw 6, the stirring screw 11, and the developing roller serving as a developer carrier continuously rotate while an image forming operation is performed. The discharge screw 2*a*, on the other hand, rotates intermittently.

In the developing device 4 of the present embodiment, a shock can be applied intermittently to the discharged developer within the discharge conveyance path 2 by intermittently driving the discharge screw 2*a*. The discharged developer, which is positioned so as to be applied with the conveying force by the rotation of the discharge screw 2*a*, repeatedly accelerates and stops as the discharge screw 2*a* is intermittently driven. Therefore, the discharged developer receives a shock intermittently at acceleration timing. Consequently, a minute vibration occurs so that the developer adhering to the discharge screw 2*a* is prevented from aggregating and the aggregated developer can be released.

In this manner, by intermittently driving the discharge screw 2*a* and intermittently apply the conveying force to the discharged developer by means of the discharge screw 2*a*, shocks can be applied to the discharged developer within the discharge conveyance path 2 intermittently. Then, the discharged developer in a section where the conveying force of the discharge screw 2*a* within the discharge conveyance path 2 is not applied also starts moving and thereby the aggregated discharged developer can be released.

Since the aggregated discharged developer can be prevented from adhering firmly within the discharge conveyance path 2, the discharged developer can be conveyed to the outside of the developing device 4 well.

In addition, the developing device 4 of the present embodiment is configured such that the discharge conveyance path 2 conveys the discharged developer in a horizontal direction. When the discharged developer is conveyed in the horizontal direction or upward direction, clogging by the discharged developer occurs mostly, but driving the discharge screw 2*a* intermittently prevents the occurrence of clogging by the discharged developer even when the discharged developer is conveyed in the horizontal direction in the developing device 4.

Moreover, it is desirable that the amount of carrier contained in the pre-mixed toner be small in consideration of the running cost for image formation. By reducing the amount of carrier contained in the pre-mixed toner, the amount of developer discharged from the developer discharge port 94 also becomes small, whereby the carrier within the developing device 4 does not have to be replaced so often and the carrier contained in the developer to be discharged becomes degraded more. Although the risk of firm adhesion of the degraded carrier within the discharge conveyance path 2 increases, driving the discharge screw 2*a* intermittently in the developing device 4 of the present embodiment can prevent the firm adhesion of the discharged developer and the occurrence of clogging of the discharge conveyance path 2.

EXAMPLE 1

Next, the first example of intermittent rotation of the discharge screw 2*a* (called "Example 1" hereinafter) will now be described.

Figure 10:
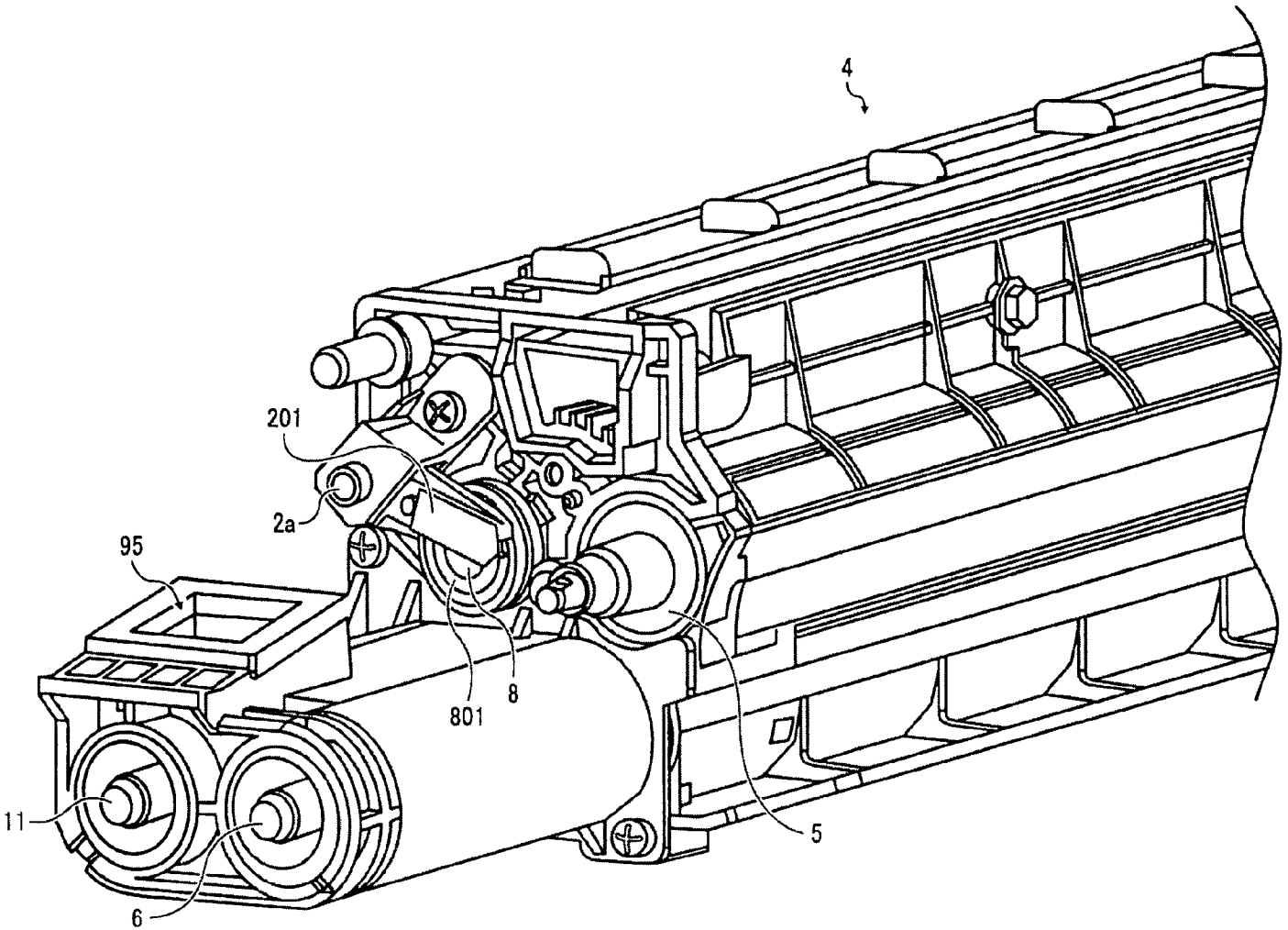
FIG. 10 is a perspective view showing the configuration of an upstream side in a conveyance direction of a discharge conveyance path of the developing device of Example 1 of this embodiment.

FIG. 10 shows the configuration on the upstream side in the conveyance direction of the discharge conveyance path 2 of the developing device 4 of Example 1. As shown in FIG. 10, the outside of the supply screw 8 in the axis direction of the casing of the developing device 4 has an eccentric cam 801, which is coaxial with the supply screw 8 and continuously rotated and driven along with the supply screw 8 by drive transmitted from the drive source of the supply screw 8. There is also provided an oscillating lever 201, which oscillates around a rotation axis of the discharge screw 2*a* as the eccentric cam 801 rotary moves.

Figure 11:
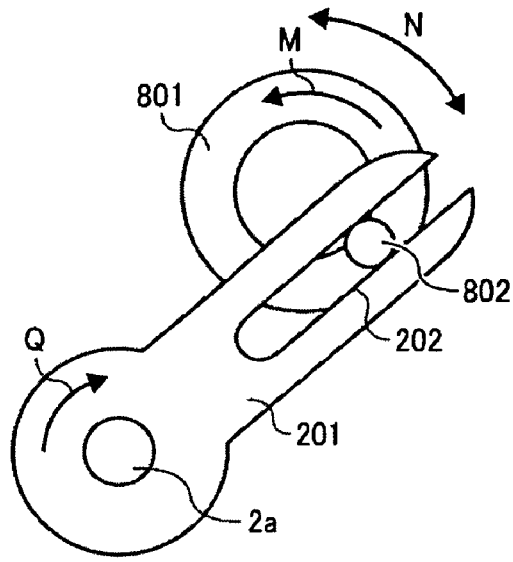
FIG. 11 is a schematic diagram showing an eccentric cam and an oscillating lever.

FIG. 11 shows the eccentric cam 801 and the oscillating lever 201.

As shown in FIG. 11, the eccentric cam 801 has a protruding portion 802 at a position eccentric with respect to the rotation axis of the supply screw 8. The oscillating lever 201 has a groove 202 with which the protruding portion 802 is brought into engagement. When the supply screw 8 is rotated and driven and the eccentric cam 801 is rotated in the direction of the arrow M, the oscillating lever 201 oscillates around the rotation axis of the discharge screw 2*a* as shown by the arrow N.

Figure 12:
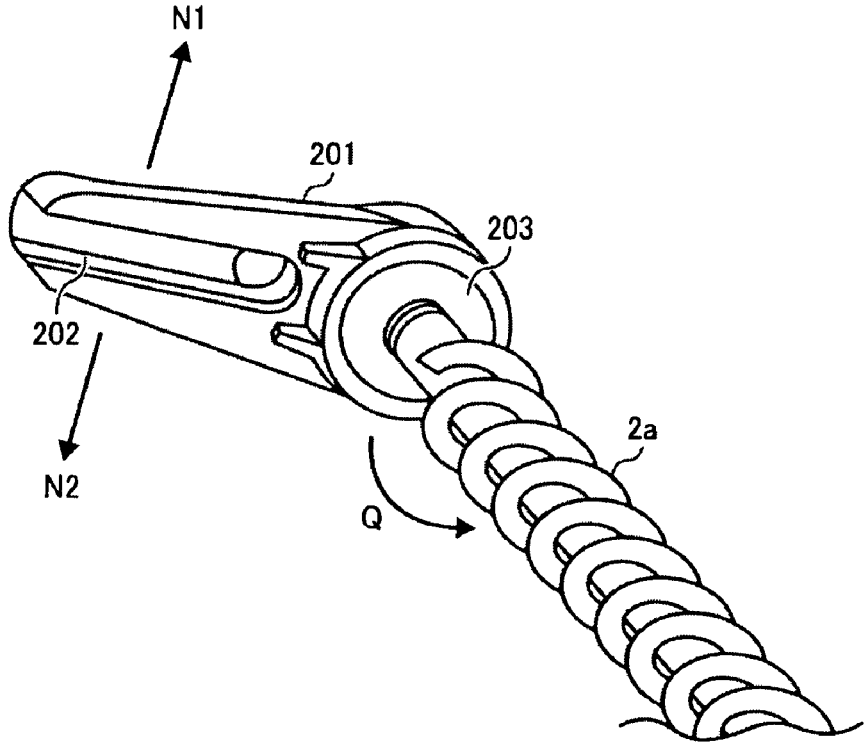
FIG. 12 is a perspective view for explaining the connection between the oscillating lever and a discharge screw.

FIG. 12 shows the connection between the oscillating lever 201 and the discharge screw 2*a*.

As shown in FIG. 12, the oscillating lever 201 is connected to the rotation axis of the discharge screw 2*a* via a one-way clutch 203. The one-way clutch 203 transmits, to the rotation axis of the discharge screw 2*a*, a downward motion (arrow N2) which is a one-way oscillation motion of the oscillating lever 201 shown by the arrow N, but does not transmit an upward motion (arrow N1) which is a backward motion. Accordingly, when the oscillating lever 201 oscillates as shown by the arrow N, the one-way clutch 203 enters a lock state with respect to the rotation axis of the discharge screw 2*a* and transmits drive as the leading end of the oscillating lever 201 moves downward (arrow N2), and thereby the discharge screw 2*a* is rotated and driven in the direction of the arrow Q in the drawing. On the other hand, the one-way clutch 203 enters an unlock state with respect to the rotation axis of the discharge screw 2*a* and does not transmit drive as the leading end of the oscillating lever 201 moves upward (arrow N1), and thereby the discharge screw 2*a* stops.

In the developing device 4 of Example 1, the oscillating lever 201 serving as intermittent rotation transmission means and the one-way clutch 203 convert the drive force of the continuous rotation of the eccentric cam 801 serving as a rotary driving member into a drive force of intermittent rotation, and transmit the converted drive force to the discharge screw 2*a*.

In the developing device 4, the continuous rotation of the supply screw 8 and eccentric cam 801 in the direction of the arrow M in the drawing causes the oscillating lever 201 to oscillate in the direction of the arrow N, and then the one-way clutch 203 transmits the drive to the discharge screw 2*a* so as to rotate it intermittently in the direction of the arrow Q. Specifically, in the developing device 4, the drive source of the supply screw 8, the supply screw 8, the eccentric cam 801, the oscillating lever 201, the one-way clutch 203 and the like constitute discharge screw intermittent rotation means for rotating the discharge screw 2*a* intermittently.

As described above, since the continuous rotation of the supply screw 8 is transmitted to drive the discharge screw 2*a* intermittently, it is not necessary to provide a drive source for the discharge screw 2*a*. Therefore, space and costs can be saved. When a drive source for the discharge screw 2*a* is provided to drive the discharge screw 2*a* intermittently, it is necessary to perform drive control so that the drive force of the drive source causes intermittent drive. In Example 1, however, since the oscillating lever 201 serving as intermittent rotation transmission means and the one-way clutch 203 convert the drive force of the continuous rotation of the eccentric cam 801 into the drive force of intermittent rotation, and transmit the converted drive force to the discharge screw 2*a*, it is not necessary to perform drive control.

The following are the conditions for the intermittent operation performed in the developing device 4 of Example 1.

| | |
|---|---|
| Rotation speed of the eccentric cam | 688 [rpm] |
| Oscillating angle of the oscillating lever | 31 [°] |
| Intermittent frequency | 11.5 [Hz] |
| Diameter of the discharge screw | φ10 [mm] |
| Rotation speed of the discharge screw | 59 [rpm] |

Note that the copying machine 500 of the present embodiment is a high-speed copying machine for continuously printing 60 to 65 pages per minute, and the rotation speed of the supply screw 8 therein is approximately 690 [rpm]. On the other hand, the discharge screw 2*a* can play a role of discharging the developer at a rotation speed of 60 [rpm]. Although there is no problem with the discharge screw 2*a* discharging the developer at a rotation speed of approximately 690 [rpm], it is costly to create a screw that can tolerate such a rotation speed of 690 [rpm]. Therefore, it is desirable to use the low rotation speed, since the discharge screw 2*a* can play such a role at a rotation speed of approximately 60 [rpm]. It is also desirable that the discharge screw 2*a* and the supply screw 8 have a common drive source, in order to achieve cost reduction. However, required rotational speed differs significantly between the supply screw 8 and the discharge screw 2*a*, and thus when drive is transmitted from the supply screw 8 the speed of driving transmission needs to be reduced to 1/10. A gear or a belt is generally used for reducing the speed, but driving transmission needs to be performed by using a large number of gears in order to achieve deceleration to 1/10. In the developing device 4 of Example 1, however, the deceleration by approximately 1/10 can be realized by using the eccentric cam 801, oscillating lever 201 and one-way clutch 203 only.

In Example 1, the eccentric cam 801 serving as a rotary driving member for transmitting drive to the discharge screw 2*a* is provided at an end portion in an axial direction of the supply screw 8, but this is not the only place to provide the eccentric cam 801. The stirring screw 11 or the recovery screw 6 may be provided with the eccentric cam 801. Also, the developing roller 5 or the photoreceptor 1 may be provided with the eccentric cam 801.

EXAMPLE 2

Next, the second example of intermittent rotation of the discharge screw 2*a* (called "Example 2" hereinafter) will now be described.

Figure 13:
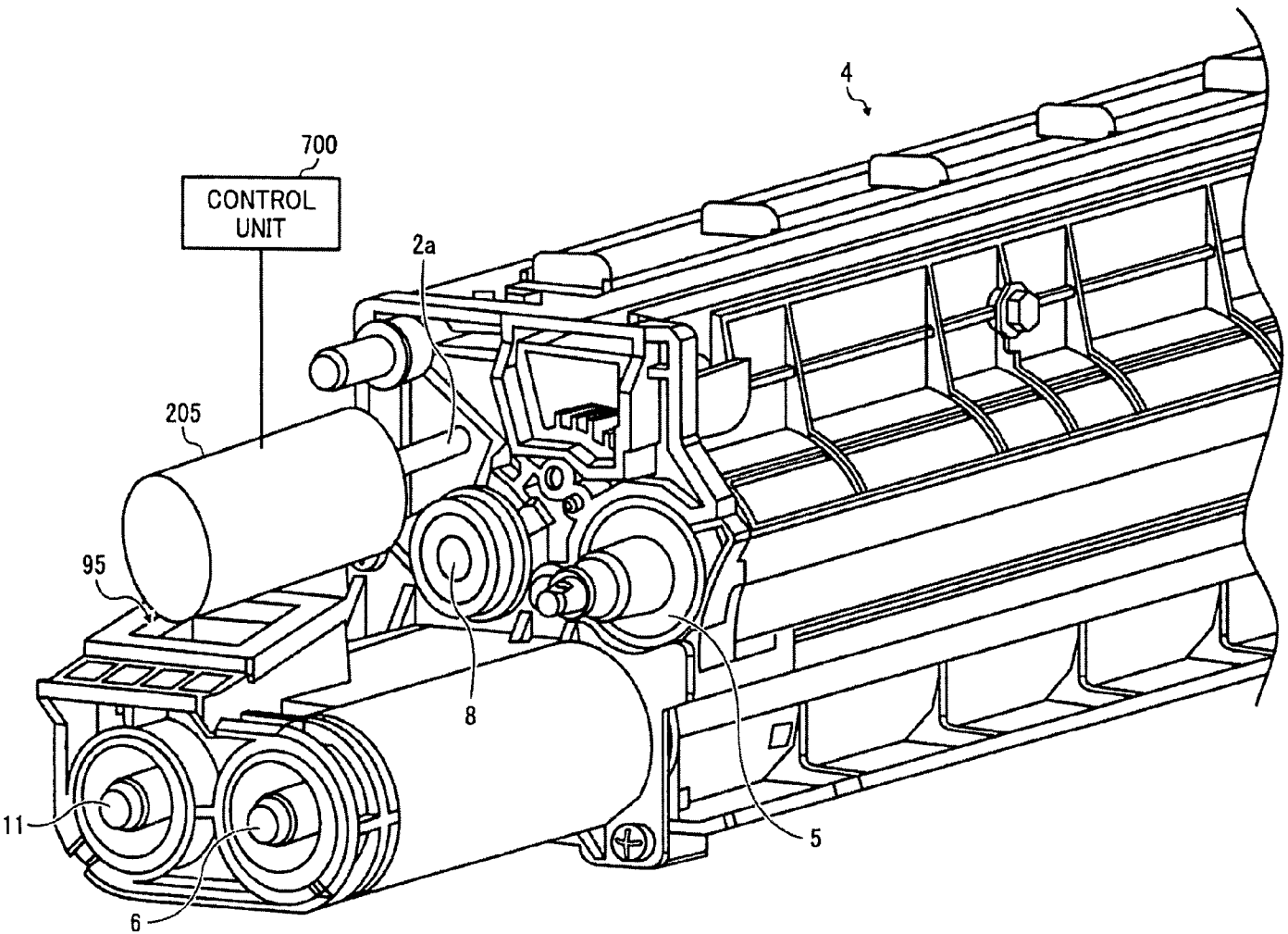
FIG. 13 is a diagram showing the developing device of Example 2 of this embodiment.

FIG. 13 shows the developing device 4 of Example 2.

As shown in FIG. 13, the developing device 4 of Example 2 has a discharge drive source 205 for the discharge screw 2*a*, which is provided independently from the other screw members. The discharge drive source 205 has a motor, an electromagnetic clutch, or the like, which is not shown, and a control unit 700 performs ON-OFF control of driving transmission by means of the electromagnetic clutch. By performing the ON-OFF control on the discharge drive source 205, the discharge screw 2*a* can be operated intermittently as with the case of Example 1, even when the other screw of the developing device 4 such as the supply screw 8, stirring screw 11 and recovery screw 6 rotate steadily.

The above embodiment describes the configuration in which a shock is intermittently applied to the developer existing within the discharge conveyance path 2 that discharges the discharged developer from the inside of the developing casing of the developing device 4 provided with the developing roller 5 serving as a developer carrier and the corresponding developer conveyance path.

The problem in which the discharged developer firmly adheres to the inner wall of the conveyance path also occurs not only in the discharge conveyance path 2, but also in the discharged-developer transfer pipe 601 serving as a discharge conveyance path, which is provided between the developing casing of the developing device 4 from which the developer is discharged by the discharge conveyance path 2 and the discharged-developer tank 600 serving as a discharged-developer container.

Therefore, as with the discharge screw 2*a*, the discharge containing screw 602 serving as a discharge containing conveying member may be intermittently driven. Specifically, the discharge containing screw drive source 603 has a motor, an electromagnetic clutch, or the like, which is not shown, and the control unit 700 performs ON-OFF control of driving transmission by means of the electromagnetic clutch. By performing the ON-OFF control on the discharge containing screw drive source 603, the discharge containing screw 602 can be rotated intermittently and the discharged developer can be prevented from firmly adhering to the inner wall of the discharged-developer transfer pipe 601. Consequently, the discharged developer can be conveyed to the discharged-developer tank 600 well.

The present embodiment describes the configuration of the developing device 4 in which intermittent driving of the discharge screw 2*a* can apply shocks to the discharged developer within the discharge conveyance path 2 intermittently. The configuration for intermittently applying shocks to the discharged developer within the discharge conveyance path 2 is not limited to the configuration for intermittently driving the discharge screw 2*a*. For example, a protruding portion that slightly contacts the wing of the discharge screw 2*a* may be provided on the inner wall of the discharge conveyance path 2. By providing such a protruding portion, the wing comes into contact with the protruding portion every time the discharge screw 2*a* rotates, whereby the discharge screw 2*a* oscillates and a shock can be applied intermittently to the discharged developer within the discharge conveyance path 2.

As described above, according to the present embodiment, in the developing device, which has: the developing roller 5 serving as a developer carrier, which rotates while carrying a developer on a surface thereof, supplies a toner to a latent image on the surface of the photoreceptor 1 serving as a latent image carrier at a section where the developing roller 5 faces the photoreceptor 1, and develops the latent image; the developer conveyance path, which has the supply screw 8 serving as a developer conveying member for conveying the developer and the supply conveyance path 9 that conveys the developer while supplying the developer to the developing roller 5 at a developer supply region for supplying the developer to the developing roller 5; the toner replenishment controller serving as developer replenishing means for replenishing the developer to the developer conveyance path; the discharge conveyance path 2 that conveys the developer to the outside of the developing device 4; the discharge screw 2*a* serving as a discharge conveying member for applying a conveying force to the developer within the discharge conveyance path 2; and the developer discharge port 94 serving as developer discharge means for discharging at least part of the developer within the developer conveyance path to the discharge conveyance path 2 in the form of discharged developer, a shock is applied intermittently to the discharged developer within the discharge conveyance path 2 so that even discharged developer that is not applied with the conveying force of the discharge screw 2*a* in the discharge conveyance path 2 starts moving and thereby the aggregated discharged developer can be released. Consequently, the aggregated discharged developer can be prevented from firmly adhering within the discharge conveyance path 2 and thereby the discharged developer can be conveyed to the outside of the developing device 4 well.

Moreover, by intermittently applying the conveying force of the discharge screw 2*a* serving as a discharge conveying member, a shock can be applied intermittently to the discharged developer within the discharge conveyance path 2, the aggregated discharged developer can be prevented from firmly adhering within the discharge conveyance path 2, and the discharged developer can be conveyed to the outside of the developing device 4 well.

In addition, the discharge conveying member is the discharge screw 2*a*, which has a rotation axis and a spiral wing provided on the rotation axis and rotates to convey the developer in the direction of the rotation axis. The discharge screw 2*a* is intermittently rotated by the discharge screw 2*a* intermittent rotation means that is configured by the drive source of the supply screw 8, the supply screw 8, the eccentric cam 801, the oscillating lever 201 and the one-way clutch 203. Consequently, the conveying force can be applied intermittently. Therefore, a shock can be applied intermittently to the discharged developer within the discharge conveyance path 2, the aggregated discharged developer can be prevented from firmly adhering within the discharge conveyance path 2, and the discharged developer can be conveyed to the outside of the developing device 4 well.

There is provided the eccentric cam 801 serving as a rotary driving member which is continuously rotated and driven by the drive force transmitted from the drive source of the supply screw 8. The discharge screw 2*a* intermittent rotation means has the intermittent rotation transmission means for converting the drive force for continuous rotation of the eccentric cam 801 into a drive force for intermittent rotation and transmitting the converted drive force to the discharge screw 2*a*. Therefore, it is not necessary to provide a drive source for the discharge screw 2*a* so that space and costs can be saved.

The are also provided the oscillating lever 201 serving as a oscillating member, which oscillates around the rotation axis of the discharge screw 2*a* as the eccentric cam 801 rotary moves, and the one-way clutch 203, which transmits one-way oscillation motion of the oscillating lever 201 to the discharge screw 2*a* but does not transmit an upward motion which is a backward motion. Accordingly, the drive force for the continuous rotation of the eccentric cam 801 can be converted into a drive force for intermittent rotation and then transmitted to the discharge screw 2*a*.

There are also provided the discharge drive source 205 serving as a discharge screw drive source for transmitting a drive force to the discharge screw 2*a*, and the control unit 700 serving as discharge drive source control means for controlling the discharge screw drive source. The control unit 700 controls the discharge drive source 205 so as to rotate the discharge screw 2*a* intermittently, whereby the conveying force can be applied intermittently by the discharge screw 2*a* serving as a discharge conveying member.

When the discharge conveyance path 2 conveys the developer in the horizontal direction or upward direction, clogging by the discharged developer occurs mostly, but driving the discharge screw 2*a* intermittently can prevent the occurrence of clogging by the discharged developer even when the discharged developer is conveyed in the horizontal direction in the developing device 4.

When the developer to be used is a two-component developer composed of toner and carrier, the carrier that is not consumed in development processing deteriorates, causing an image failure. However, since the pre-mixed toner containing carrier is replenished from the toner replenishing port 95 so that the developer containing the deteriorated carrier can be discharged from the developer discharge port 94, the carrier within the developing device 4 can be replaced and good image formation can be carried out.

Furthermore, by applying a shock intermittently to the developer existing within the discharge conveyance path 2 within the developing casing of the developing device 4 that is provided with the developer conveyance paths having at least the supply conveyance path 9, stirring conveyance path 10 and recovery conveyance path 7 and the developing roller 5 serving as a developer carrier, the discharged developer can be discharged to the outside of the developing casing well.

Moreover, a shock is applied intermittently to the developer that is discharged from the developing casing of the developing device 4 provided with the developer conveyance paths having at least the supply conveyance path 9, stirring conveyance path 10 and recovery conveyance path 7 and the developing roller 5 serving as a developer carrier and exists within the discharge developer transfer pipe 601 serving as a discharge conveyance path between the developing casing and the discharged-developer tank 600 serving as a discharged-developer container for containing the discharged developer. Accordingly, the discharged developer that is discharged from the developing casing can be conveyed to the discharged-developer tank 600 well.

The developing device 4 serving as developing means is provided in the copying machine 500 serving as an image forming apparatus, which has at least the photoreceptor 1 serving as a latent image carrier, the charging unit serving as charging means for charging the surface of the photoreceptor 1, the optical writing unit 21 serving as latent image forming means for forming an electrostatic latent image on the photoreceptor 1, and the developing means for developing the electrostatic latent image into a toner image. Therefore, the discharged developer can be conveyed to the outside of the developing device 4 well, whereby the carrier within the developing device 4 can be replaced and good image formation can be carried out.

In addition, the developing device 4 serving as developing means is provided in the process cartridge 18, which is configured to have at least the photoreceptor 1 serving as a latent image carrier for carrying a latent image and the developing means for developing the latent image on the photoreceptor 1, in a common holder as one unit, and is also configured detachably from the main body of the copying machine 500 serving as an image forming apparatus that has the photoreceptor 1 and the developing means. Accordingly, the discharged developer can be conveyed to the outside of the developing device 4 well, whereby the carrier within the developing device 4 can be replaced and the developing device 4 which enables good image formation can be easily attached to/detached from the copying machine 500.

According to the present invention, since the discharged developer can be prevented from remaining aggregated in the discharge conveyance path as described above, the present invention can exert the effects of preventing the aggregated discharged developer from firmly adhering within the discharge conveyance path and conveying the discharged developer to the outside of the developing device well. In addition, by applying a shock intermittently to the discharged developer within the discharge conveyance path conveying the developer to the outside of the developing device, even the discharged developer that is not applied with the conveying force of the discharge conveying member in the discharge conveyance path starts moving and thereby the aggregated discharged developer can be released.

Various modifications will become possible for those skilled in the art after receiving the teachings of the present disclosure without departing from the scope thereof.

What is claimed is:

1. A developing device, comprising:

a developer carrier, which rotates while carrying a developer on a surface thereof, supplies a toner to a latent image on a surface of a latent image carrier at a section where the developer carrier faces the latent image carrier, and develops the latent image;

a developer conveyance path, which has a developer conveying member conveying the developer, and conveys the developer while supplying the developer to the developer carrier in a developer supply region in which the developer is supplied to the developer carrier;

a developer replenishing port which replenishes the developer to the developer conveyance path;

a discharge conveyance path for conveying the developer to the outside of the developing device;

a discharge conveying member, which applies a conveying force to the developer within the discharge conveyance path; and a developer discharging port which discharges at least part of the developer within the developer conveyance path to the discharge conveyance path in the form of a discharged developer, wherein a shock is applied intermittently to the discharged developer within the discharge conveyance path inside a developing casing provided with at least the developer carrier and the developer conveyance path.

2. The developing device as claimed in claim 1, wherein intermittent application of the conveying force by the discharge conveying member applies a shock intermittently to the discharged developer within the discharge conveyance path.

3. The developing device as claimed in claim 2, wherein the discharge conveying member is a discharge screw that has a rotation axis and a spiral wing portion provided on the rotation axis and conveys the developer in a direction of the rotation axis by rotating, and wherein the discharge screw is intermittently rotated.

4. The developing device as claimed in claim 3, further comprising:

a rotary driving member, which is continuously rotated and driven by a drive force transmitted from a drive source, wherein the discharge screw is intermittently rotated by a device which converts the drive force for continuous rotation of the rotary driving member into a drive force for intermittent rotation and transmitting the converted drive force to the discharge screw.

5. The developing device as claimed in claim 4, wherein the device which converts includes:

an oscillating member that oscillates around the rotation axis of the discharge screw as the rotary driving member performs rotary motion; and a one-way clutch that connects the oscillating member and the discharge screw together, and wherein the one-way clutch transmits one-way oscillation motion of the oscillating member to the rotation axis of the discharge screw but does not transmit a backward motion.

6. The developing device as claimed in claim 3, further comprising:

a discharge screw drive source that transmits a drive force to the discharge screw; and discharge drive source controller for controlling the drive of the discharge screw drive source, wherein the discharge drive source controller controls the discharge screw drive source so that the discharge screw is rotated intermittently.

7. The developing device as claimed in claim 1, wherein the discharge conveyance path conveys the developer in a horizontal direction or an upward direction.

8. The developing device as claimed in claim 1, wherein the developer to be used is a two-component developer comprising toner and carrier.

9. The developing device as claimed in claim 1, wherein a shock is applied intermittently to the developer which is discharged from the developing casing provided with at least the developer carrier and the developer conveyance path, and which exists within the discharge conveyance path before reaching a discharged-developer container for containing the discharged developer.

10. An image forming apparatus, comprising:

at least a latent image carrier;

a charger to charge a surface of the latent image carrier;

a light to form an electrostatic latent image on the latent image carrier; and a developer to develop the electrostatic latent image into a toner image, wherein the developer comprises:

a developer carrier, which rotates while carrying a developer on a surface thereof, supplies a toner to a latent image on the surface of the latent image carrier at a section where the developer carrier faces the latent image carrier, and develops the latent image;

a developer conveyance path, which has a developer conveying member conveying the developer, and conveys the developer while supplying the developer to the developer carrier in a developer supply region in which the developer is supplied to the developer carrier;

a developer replenishing port which replenishes the developer to the developer conveyance path;

a discharge conveyance path for conveying the developer to the outside of the developer;

a discharge conveying member, which applies a conveying force to the developer within the discharge conveyance path; and a developer discharging port which discharges at least part of the developer within the developer conveyance path to the discharge conveyance path in the form of a discharged developer, the discharged developer within the discharge conveyance path being applied with a shock intermittently inside a developing casing provided with at least the developer carrier and the developer conveyance path.

11. A process cartridge, which is configured to have at least a latent image carrier for carrying a latent image and developer for developing the latent image on the latent image carrier, in a common holder as one unit, and is further configured to be detachable from a main body of an image forming apparatus that has the latent image carrier and the developer, wherein the developer comprises:

a developer carrier, which rotates while carrying a developer material on a surface thereof, supplies a toner to a latent image on the surface of the latent image carrier at a section where the developer carrier faces the latent image carrier, and develops the latent image;

a developer conveyance path, which has a developer conveying member conveying the developer material, and conveys the developer material while supplying the developer material to the developer carrier in a developer supply region in which the developer material is supplied to the developer carrier;

a developer replenishing port which replenishes the developer material to the developer conveyance path;

a discharge conveyance path for conveying the developer material to the outside of the developer;

a discharge conveying member, which applies a conveying force to the developer material within the discharge conveyance path; and a developer discharging port which discharges at least part of the developer material within the developer conveyance path to the discharge conveyance path in the form of a discharged developer material, the discharged developer material within the discharge conveyance path being applied with a shock intermittently inside a developing casing provided with at least the developer carrier and the developer conveyance path.

12. A developing device, comprising:

a developer carrier, which rotates while carrying a developer on a surface thereof, supplies a toner to a latent image on a surface of a latent image carrier at a section where the developer carrier faces the latent image carrier, and develops the latent image;

a developer conveyance path, which has a developer conveying member conveying the developer, and conveys the developer while supplying the developer to the developer carrier in a developer supply region in which the developer is supplied to the developer carrier;

a developer port which replenishes the developer to the developer conveyance path;

a discharge conveyance path for conveying the developer to the outside of the developing device;

a discharge conveying member, which applies a conveying force to the developer within the discharge conveyance path; and a developer discharging port which discharges at least part of the developer within the developer conveyance path to the discharge conveyance path in the form of a discharged developer, wherein a shock is applied intermittently to the discharged developer within the discharge conveyance path, intermittent application of the conveying force by the discharge conveying member applies a shock intermittently to the discharged developer within the discharge conveyance path, and the discharge conveying member is a discharge screw that has a rotation axis and a spiral wing portion provided on the rotation axis and conveys the developer in a direction of the rotation axis by rotating, and wherein the developing device further comprises discharge screw intermittent rotator for intermittently rotating the discharge screw.

* * * * *